US012594641B2

(12) United States Patent
Schneider et al.

(10) Patent No.: US 12,594,641 B2
(45) Date of Patent: Apr. 7, 2026

(54) APPARATUS AND METHOD FOR PROCESSING OPTICAL WORKPIECES

(71) Applicant: Schneider GmbH & Co. KG, Fronhausen (DE)

(72) Inventors: Gunter Schneider, Marburg (DE); Klaus Hofmann, Wehrheim (DE); Hans-Joachim Link, Biedenkopf (DE)

(73) Assignee: Schneider GmbH & Co. KG, Fronhausen (DE)

( * ) Notice: Subject to any disclaimer, the term of this patent is extended or adjusted under 35 U.S.C. 154(b) by 717 days.

(21) Appl. No.: 17/393,450

(22) Filed: Aug. 4, 2021

(65) Prior Publication Data

US 2022/0040811 A1 Feb. 10, 2022

(30) Foreign Application Priority Data

Aug. 7, 2020 (DE) ..... 10 2020 004 815.3
Aug. 19, 2020 (DE) ..... 10 2020 005 090.5

(51) Int. Cl.
*B24B 13/00* (2006.01)
*B24B 13/02* (2006.01)
(Continued)

(52) U.S. Cl.
CPC ..... *B24B 13/0031* (2013.01); *B24B 13/00* (2013.01); *B24B 13/0037* (2013.01);
(Continued)

(58) Field of Classification Search
CPC ..... B24B 13/0031; B24B 13/0037; B24B 13/005; B24B 13/02; B24B 13/00;
(Continued)

(56) References Cited

U.S. PATENT DOCUMENTS 2,994,164 A * 8/1961 Dalton ..... B24B 13/0037 451/42
7,278,908 B2 10/2007 Urban et al.
(Continued)

FOREIGN PATENT DOCUMENTS

DE 102004021721 B3 10/2005
DE 202009000790 U1 3/2009
(Continued)

*Primary Examiner* — Michael A Gump
(74) *Attorney, Agent, or Firm* — Jason H. Vick; Amped IP LLC

(57) ABSTRACT

The present invention relates to an apparatus for processing optical workpieces, having a working space, wherein workpiece spindles for receiving and holding the optical workpieces and tool spindles with processing tools receivable thereon for processing the optical workpieces are arranged in the working space, wherein the tool spindles are arranged rotatably about their center axis, wherein the tool spindles are arranged linearly movably along their center axes. It is provided that at least two pairs of tool spindles are provided, that at least one device for rotational drive is provided for the at least two pairs of tool spindles, that at least one device for linear drive is provided for the at least two pairs of tool spindles along their center axes. The present invention further relates to a method for processing optical workpieces.

19 Claims, 23 Drawing Sheets

(51) Int. Cl.
*B24B 27/00* (2006.01)
*B24B 41/02* (2006.01)
*B24B 49/12* (2006.01)

(52) U.S. Cl.
CPC ..... *B24B 13/02* (2013.01); *B24B 27/0076* (2013.01); *B24B 41/02* (2013.01); *B24B 49/12* (2013.01)

(58) Field of Classification Search
CPC ..... B24B 13/023; B24B 13/026; B24B 13/04; B24B 55/02; B24B 27/0069; B24B 27/0076; B24B 27/0023; B24B 49/12; B24B 41/02; B24B 41/04; B24B 47/02; B24B 47/10; B24B 47/22; B24B 53/007; B24D 13/147
USPC .... 451/42, 43, 54, 57, 58, 59, 65, 240, 255, 451/256, 277, 285, 290, 390, 444
See application file for complete search history.

(56) References Cited

U.S. PATENT DOCUMENTS

| | | | | |
|---|---|---|---|---|
| 7,422,510 | B2 | 9/2008 | Schneider et al. | |
| 8,029,341 | B2 | 10/2011 | Belly et al. | |
| 8,267,743 | B2 | 9/2012 | Schneider et al. | |
| 8,628,071 | B2 | 1/2014 | Fiedler et al. | |
| 9,289,877 | B2 | 3/2016 | Schafer et al. | |
| 9,815,166 | B2 * | 11/2017 | Goldstein | B23Q 17/2409 |
| 10,583,540 | B2 | 3/2020 | Wallendorf et al. | |
| 10,695,886 | B2 | 6/2020 | Schneider et al. | |
| 10,781,050 | B2 | 9/2020 | Schneider | |
| 11,801,580 | B1 * | 10/2023 | Allford | B24B 37/005 |
| 2002/0176756 | A1 | 11/2002 | Gottschald et al. | |
| 2002/0186370 | A1 * | 12/2002 | Roesner | B24B 49/183 356/301 |
| 2004/0029496 | A1 * | 2/2004 | Mizuno | B24B 55/12 451/43 |
| 2006/0260448 | A1 | 11/2006 | Fiedler et al. | |
| 2007/0293128 | A1 * | 12/2007 | Schafer | B24B 13/0037 451/7 |
| 2008/0051015 | A1 | 2/2008 | Schneider et al. | |
| 2008/0305723 | A1 | 12/2008 | Philipps et al. | |
| 2011/0084433 | A1 * | 4/2011 | Fiedler | B23Q 7/046 269/56 |
| 2011/0201255 | A1 * | 8/2011 | Tanaka | B24B 13/0055 451/5 |
| 2013/0214494 | A1 * | 8/2013 | Kiontke | B24B 13/005 279/46.3 |
| 2013/0273815 | A1 * | 10/2013 | Schneider | B24B 13/0055 451/8 |
| 2013/0344778 | A1 * | 12/2013 | Schafer | B24B 41/04 451/294 |
| 2014/0073227 | A1 | 3/2014 | Schneider et al. | |
| 2014/0094092 | A1 * | 4/2014 | Thomas | B24B 5/36 451/11 |
| 2016/0361790 | A1 * | 12/2016 | Mandler | B24B 13/023 |
| 2017/0246720 | A1 * | 8/2017 | Wallendorf | B24B 9/14 |
| 2018/0236624 | A1 * | 8/2018 | Dewees | B24B 9/14 |
| 2018/0361534 | A1 | 12/2018 | Schneider et al. | |
| 2019/0134770 | A1 * | 5/2019 | Bernhardt | B24B 49/12 |
| 2019/0136367 | A1 * | 5/2019 | Peter | C23C 14/30 |
| 2021/0016410 | A1 | 1/2021 | Geist et al. | |

FOREIGN PATENT DOCUMENTS

| | | | |
|---|---|---|---|
| DE | 102009048757 | A1 | 4/2011 |
| DE | 102011014230 | A1 | 9/2012 |
| DE | 102014015053 | A1 | 4/2016 |
| DE | 102016112999 | A1 | 1/2018 |
| DE | 102019005084 | A1 | 1/2021 |
| EP | 1250979 | A2 | 10/2002 |
| EP | 1698432 | A2 | 9/2006 |
| EP | 2502702 | B1 | 3/2014 |
| EP | 2822883 | B1 | 5/2017 |
| EP | 3418000 | A1 | 12/2018 |
| KR | 2014-0142529 | A | 12/2014 |
| WO | WO 2012/126604 | A2 | 9/2012 |

* cited by examiner

APPARATUS AND METHOD FOR PROCESSING OPTICAL WORKPIECES

CROSS-REFERENCE TO RELATED APPLICATIONS

This application claims the benefit under 35 U.S.C. 119(a) to German Patent Application No. 10 2020 004 815.3, filed 7 Aug. 2020 and German Patent Application 10 2020 005 090.5, filed 19 Aug. 2020, the disclosure of each are incorporated herein by reference in their entirety.

BACKGROUND

Field of the Invention

The present invention relates to an apparatus for processing optical workpieces. The present invention further relates to a method for processing optical workpieces.

Description of Related Art

An apparatus for polishing lenses for eyeglass lenses is known from WO 2012/126604 A2 and EP 2 502 702 B1. The apparatus is characterized by an automation of the lens change and tool change. The lenses to be polished or processed are automatically transported into the apparatus, while the finished processed lenses are automatically transported out of the apparatus. Depending on the processing task, different polishing tools are kept in magazines so that also lenses with extreme geometries, e.g. a high diopter value, can be polished. Here, a necessary tool change, depending on the processing task, is also carried out automatically.

SUMMARY

The object of the present invention is to further simplify an apparatus for processing optical workpieces while providing a broader range of applications.

The above object is solved by an apparatus or by a method as disclosed herein.

According to a first aspect of the invention, the proposed apparatus is characterized in that the device for linear drive comprises a slide on which the pair of tool spindles is mounted, and in that the slide is arranged on a linear guide so as to be linearly movable along the center axes of the pair of tool spindles.

The proposed apparatus has a substantially simplified construction compared to the prior art, since now the pair of tool spindles is fixed on its slide provided for this purpose and the infeed or movement of the pair of tool spindles in the direction of the workpiece spindles or the optical workpieces received thereon (i.e. in the direction of the Z-axis of the apparatus) is effected only via the movement of the slide provided. In other words, the respective Z axes are outsourced from or removed from or moved out of the pair of tool spindles.

A second aspect of the invention, which can also be implemented independently, is that in the apparatus, at least two pairs of tool spindles are provided, that at least one device for rotational drive and, preferably, two devices for rotational drive, are provided for the at least two pairs of tool spindles, and that at least one device for linear drive and, preferably, two devices for linear drive, are provided for the at least two pairs of tool spindles along their center axes.

This proposed construction allows the apparatus to be used much more flexibly and/or in a wider range of applications.

Particularly preferably, a two-stage processing method can be implemented by the optical workpieces received on workpiece spindles being able to be processed first by means of processing tools located on a first pair of tool spindles. Subsequently, the optical workpieces can be processed by means of processing tools located on a second or further pair of tool spindles. Particularly advantageously, the same or different processing tools can be used for each pair of tool spindles.

The development of the proposed apparatuses was carried out with regard to the fact that, contrary to the state of the art cited above, both a tool magazine and an automated apparatus for tool change became dispensable.

A further consequence is that now the change of the processing tools in case of wear or damage is not only possible manually, but especially preferably always carried out manually.

A third aspect of the invention, which can also be implemented independently, relates to a method in which it is provided that for processing the optical workpieces a preprocessing step is carried out with a first pair of tool spindles with first processing tools mounted thereon and that immediately thereafter, i.e. without interrupting the process, in particular without changing tools, a post-processing step is carried out with a second pair of tool spindles with second processing tools mounted thereon.

In a particularly preferred embodiment, at least two pairs of tool spindles are provided, wherein each device for linear drive has at least two slides, on each of which a pair of tool spindles is mounted, and wherein each slide is arranged on a linear guide so as to be linearly movable along the center axes of the respective pair of tool spindles. In this preferred further development, the respective Z axes are also removed from or outsourced from or moved out of the pairs of tool spindles.

A further particularly preferred construction of the apparatus is that a handling device for handling the optical workpieces is provided outside the working space on a first side of the working space and that the at least one device for linear drive is arranged on a second side of the working space facing away from the first side of the working space.

The at least one device for linear drive is thus arranged on the edge side within the apparatus, i.e. after removal of the corresponding part of the casing of the apparatus, the at least one apparatus for linear drive is freely accessible, in particular for maintenance and repair purposes.

It is also conceivable to combine two pairs of tool spindles with two pairs of workpiece spindles in an appropriately dimensioned apparatus, so that four optical workpieces can be processed simultaneously in one processing step.

In a preferred embodiment, a device for rotational drive of the tool spindles can be realized in that, respectively, a pair of tool spindles can be driven synchronously in rotation.

A preferred device for linear drive of a pair of tool spindles has a toothed rack fixed to the respective slide, which meshes with a rotationally drivable gear wheel or toothed wheel. This ensures that each pair of tool spindles can be synchronously driven linearly.

A particularly preferred embodiment of the present invention provides that each device for linear drive is arranged on at least one base plate. Particularly preferably, a base plate is provided, on the upper side of which a first device for linear drive and on the lower side of which a second device for linear drive are provided.

In particular, the second device for linear drive can be arranged essentially mirrored to the first device for linear drive, wherein the common base plate forms the mirror plane.

This particularly preferred form of modular construction of the two devices for linear drive makes it possible in a particularly simple manner to manufacture apparatuses with, in particular, one pair or two pairs of tool spindles according to customer requirements.

The preferred modular structure described above allows in particular that preferably one pair of tool spindles or two pairs of tool spindles can be provided. This makes it possible, depending on the customer's requirements, to provide apparatuses in which the actual processing of the optical workpieces is carried out in one stage, i.e. in one processing step (with one pair of tool spindles) or in two stages, i.e. in two processing steps (with two pairs of tool spindles, each pair being equipped with different processing tools).

A further preferred further development of the apparatus is that a tool holder is attached or fixed to each tool spindle, on which tool holder a processing tool is rigidly received or rigidly held.

The aforementioned aspects and features as well as the aspects and features of the present invention resulting from the claims and the following description can in principle be realized independently of each other, but also in any combination.

An exemplary embodiment of the present invention is described in more detail below with reference to the accompanying drawings in schematic, not to scale representation.

DETAILED DESCRIPTION

In the figures, some of which are not to scale and are merely schematic, the same reference signs are used for the same, similar or alike parts and components, wherein corresponding or comparable properties and advantages are achieved, even if a repeated description is omitted.

Figure 1:
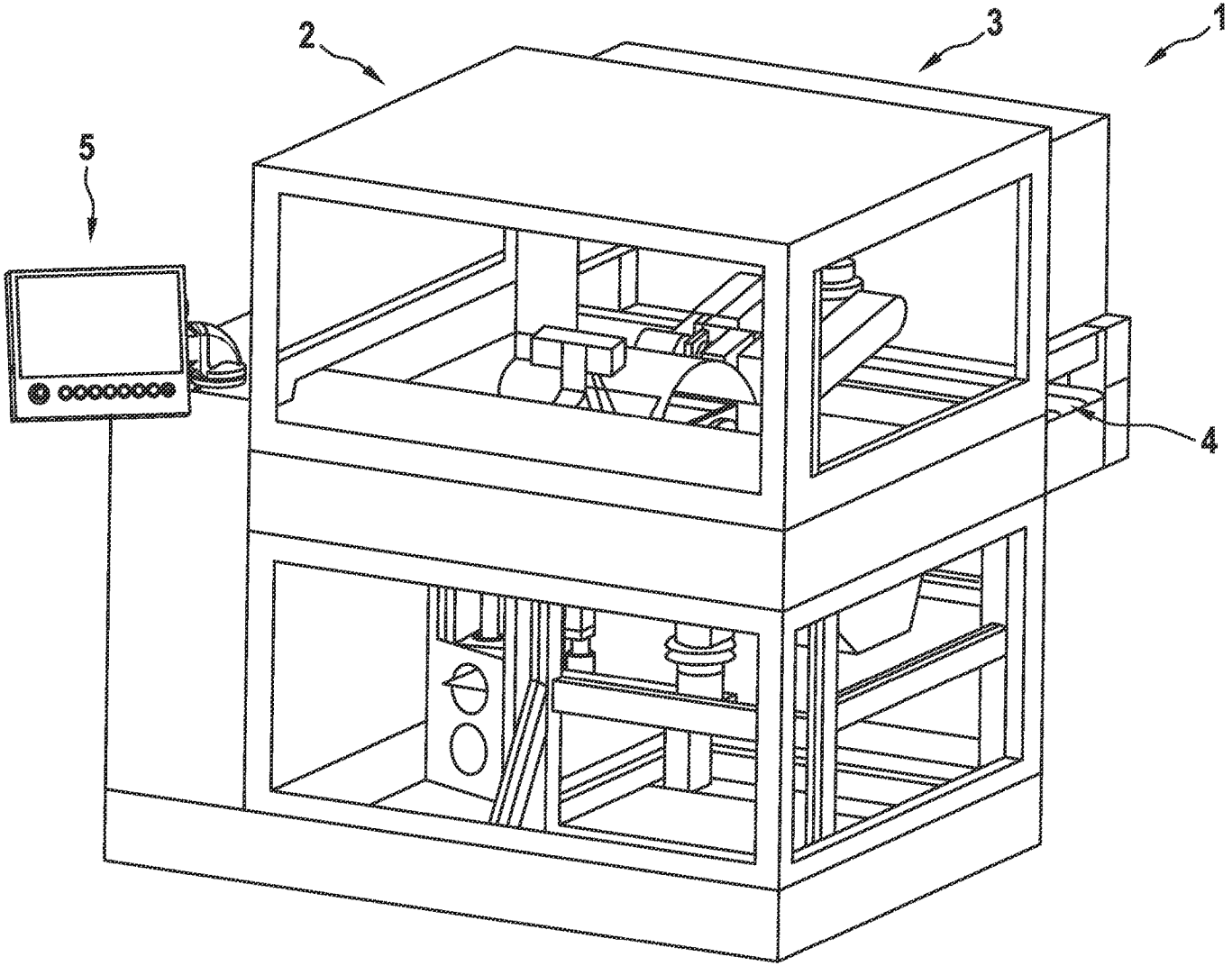
FIG. 1 is an exemplary embodiment of a proposed apparatus in a perspective total view.

FIG. 1 shows an exemplary embodiment of an apparatus 1 according to the invention in a perspective view. The apparatus 1 is used for processing optical workpieces 9, in particular optical surfaces of workpieces 9 such as, for example, optical surfaces of lenses, in particular spectacle lenses.

The apparatus 1 has a casing 2 which encloses a plurality of work stations as well as peripheral devices (see below). A part 3 of the casing 2 covers a conveyor device 4, in the exemplary embodiment a conveyor belt, so that the apparatus 1 can be integrated into a system for processing optical workpieces 9 with a plurality of separate processing devices, such as is known, for example, from EP 2 822 883 B1.

In the exemplary embodiment, the apparatus 1 is CNC-controlled, so that a control panel 5 is provided with which an operator can control and monitor the functions of the apparatus 1 and/or the processing sequences when processing the optical workpieces 9.

Figure 2:
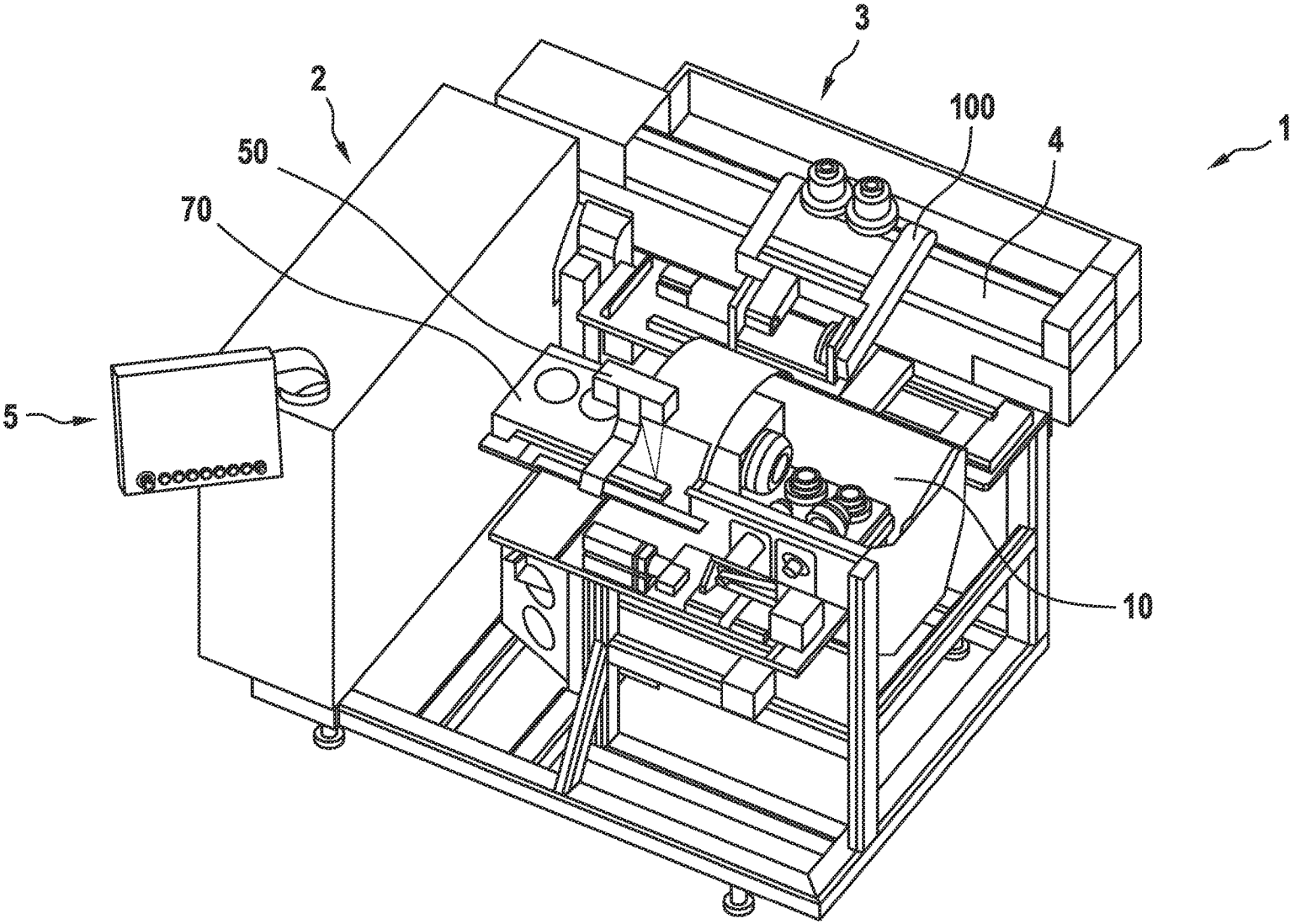
FIG. 2 is the apparatus according to FIG. 1 in a perspective internal view from above.

FIG. 2 shows an interior view of the apparatus 1 according to FIG. 1. The casing 2 encloses a working chamber 10, a cleaning station 70 and/or a handling device 100 for handling the optical workpieces 9 to be processed.

A device for tool inspection 50 is used for sensory inspection of the processing tools 320 used in the apparatus 1 (see below).

Figure 3A:
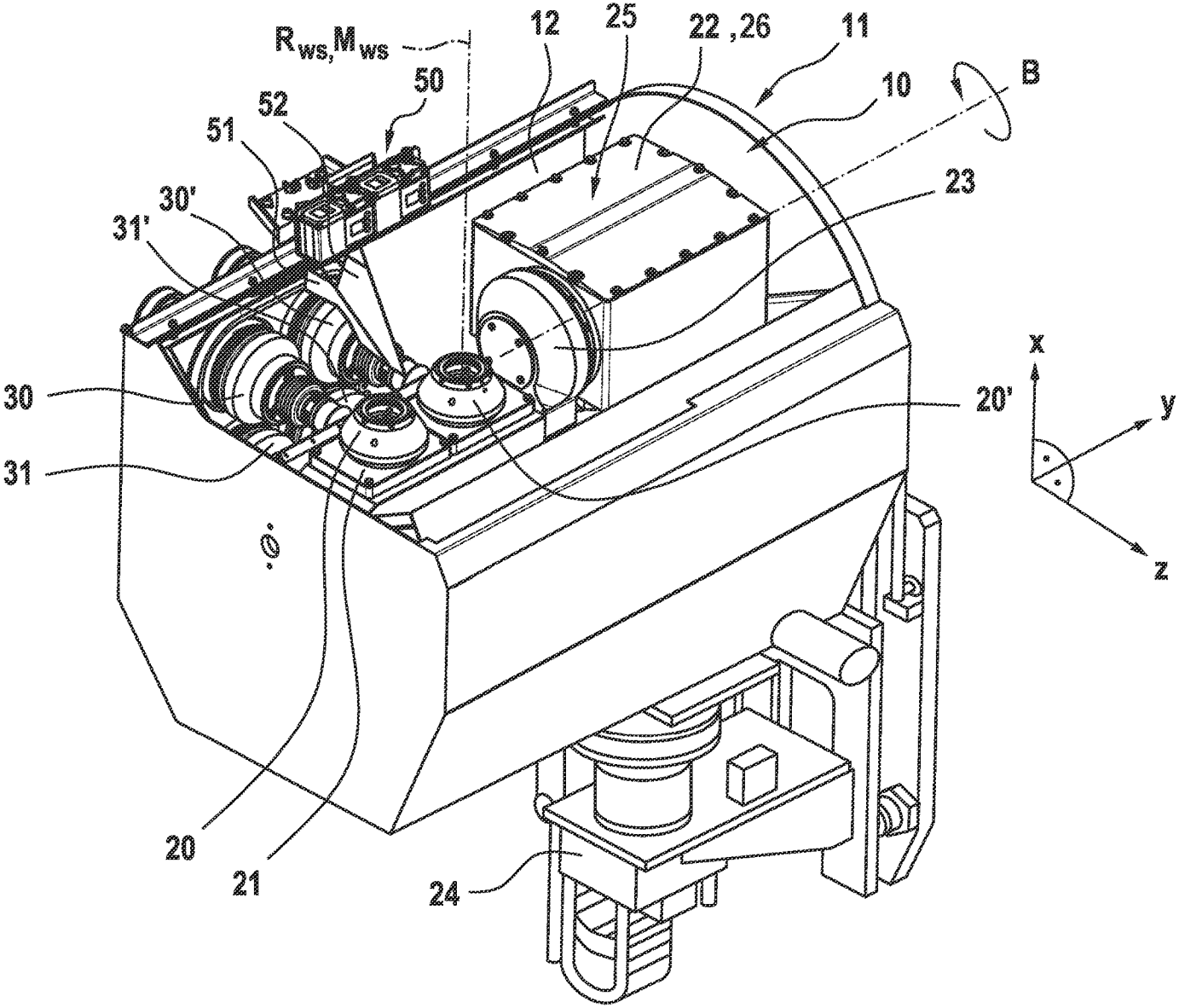
FIG. 3A is a perspective view of an exemplary embodiment of a working chamber of the apparatus according to FIG. 1.

A working chamber 10 for use in the apparatus 1 is shown in a perspective view in FIG. 3A.

The working chamber 10 has a chamber housing 11 which encloses a working space 12.

The chamber housing 11 can be opened and closed by means of a movable cover as described, for example, in WO 2012/126604 A2 (not shown).

Two workpiece spindles 20, 20', known per se, are arranged within the working space 12. The workpiece spindles 20, 20' are accommodated on a common spindle housing 21.

The distance between the center axes $M_{WS}$ of the workpiece spindles 20, 20' running parallel to the X axis of the apparatus 1 is 130 mm in the example; this corresponds to the preset distance between the center axes Mw of the optical workpieces 9 to be processed.

The X axis, Y axis and Z axis of the apparatus 1 are shown in FIG. 3A. The terms "X direction", "Y direction" and "Z direction" preferably refer to these axes.

The X axis, Y axis and Z axis preferably form an orthogonal basis or are mutually orthogonal.

Preferably, the X direction is the vertical direction and the Y and Z direction are the respective horizontal directions, in particular orthogonal or perpendicular to each other.

The workpiece spindles 20, 20' are arranged rotatably about a rotation axis $R_{WS}$, wherein in the exemplary embodiment the rotation axis $R_{WS}$ coincides with the respective center axis $M_{WS}$ of the workpiece spindles 20, 20'. Drive devices known per se for this rotation of the workpiece spindles 20, 20' are accommodated in the spindle housing 21.

In the exemplary embodiment, the spindle housing 21 and thus the workpiece spindles 20, 20' are designed to be pivotable about the B-axis of the apparatus 1 by means of a swivel drive 25.

In the exemplary embodiment, the swivel drive 25 has a motor 26 with a shaft gear (hereinafter: gear motor 26) with a hollow shaft for the cable feed-through (not shown), known per se, the motor 26 being accommodated in a B-axis housing 22 for protection against contamination.

A B-axis flange 23 is attached to the B-axis housing 22, which is operatively connected on the one hand to the gear motor 26 and on the other hand to the spindle housing 21.

The entire structural unit with the workpiece spindles 20, 20', the spindle housing 21 and the B-axis housing 22 together with the gear motor 26 and B-axis flange 23 is further designed to be movable along the X-axis of the apparatus 1. On the one hand, this has the effect that the workpiece spindles 20, 20' can be loaded with optical workpieces 9 (see below). On the other hand, the infeed or movement of the optical workpieces 9 to the processing tools 320 can be optimized (see below).

In a manner known per se, an X-axis motor 24 drives, via a ball screw, a base plate to which the B-axis housing 22 is connected via a cylinder and a cantilevered plate (not shown).

In the illustrated embodiment, two pairs of tool spindles 30, 30' and 31, 31', respectively, are accommodated within the working space 12.

The first, in X-direction upper pair of spindles 30, 30' is used for a first processing step, while the second, in X-direction lower pair of spindles 31, 31' is used for a second processing step. The optical workpieces 9 are thus processed in a two-stage processing method.

However, it is also possible to provide only one pair of tool spindles 30, 30' or 31, 31', preferably the upper pair of tool spindles 30, 30' in the direction of the X axis of the apparatus 1. In this case, the optical workpieces may be processed in a single-stage processing method.

Furthermore, it is also possible, for example, to equip two pairs of tool spindles 30, 30'; 31, 31' with identical processing tools 320 and to process the optical workpieces 9 in a single-stage processing method. In this case, the tool change interval is doubled, i.e. four instead of two processing tools 320 have to be replaced after the doubled service life, whereby an interruption of the processing of the optical workpieces 9 is required only once per work shift of the respective operator, for example.

It is also possible to enlarge the working space 12 of the working chamber 10 in such a way that two pairs of workpiece spindles are arranged on a correspondingly enlarged spindle housing, to which two pairs of tool spindles 30, 30'; 31, 31' are assigned. In this case, four optical workpieces 9 can be processed simultaneously in a single-stage processing method.

For each pair of tool spindles 30, 30' and/or 31, 31' a device 47, 47' for rotational drive of the respective pair of tool spindles 30, 30' and/or 31, 31' as well as a device 48, 48' for linear drive of the respective pair of tool spindles 30, 30' and/or 31, 31' along the Z-axis of the apparatus 1 and/or along center axes $M_{WZ}$ of the respective tool spindles 30, 30' and/or 31, 31' arranged parallel thereto are provided.

Figure 3B:
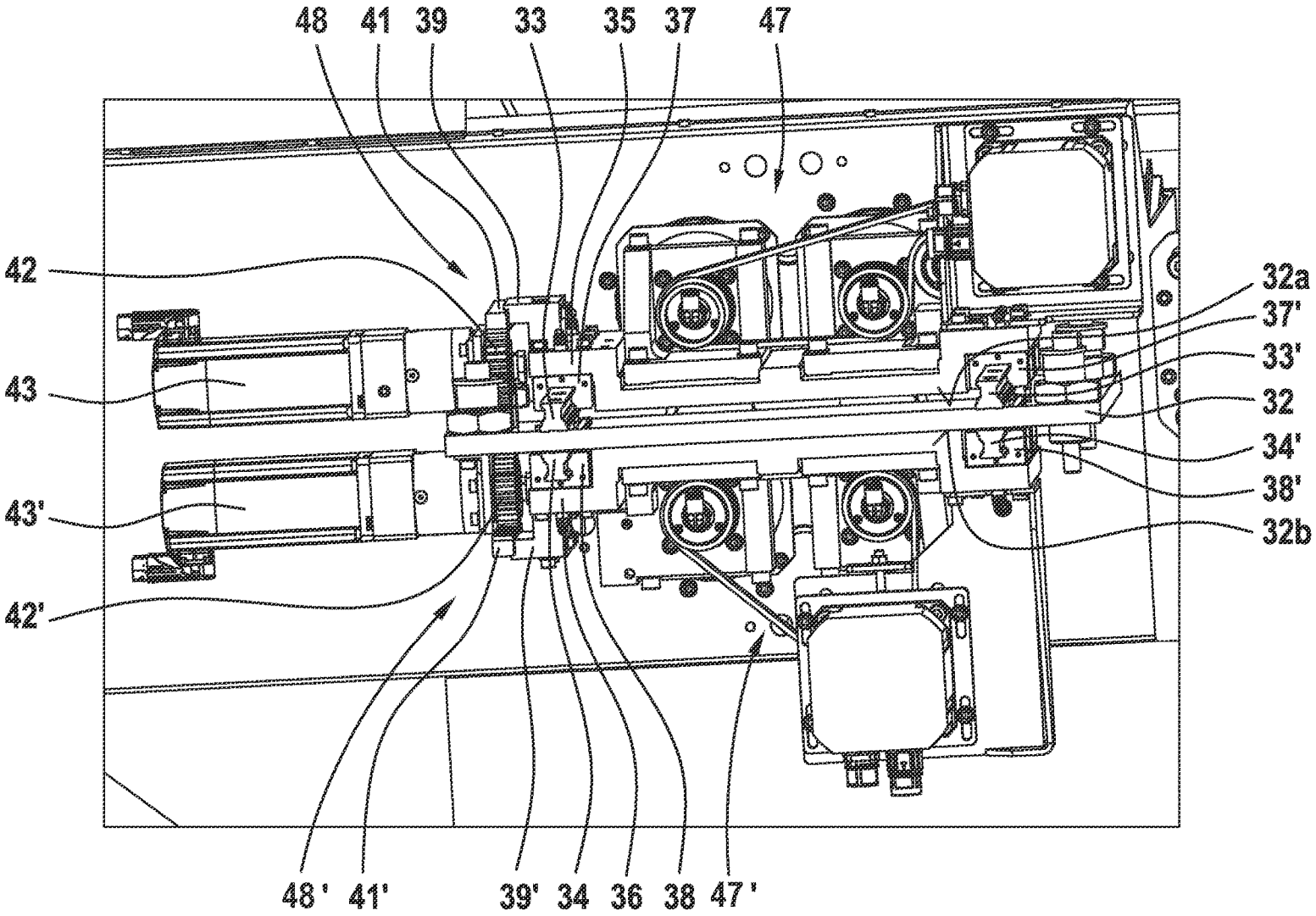
FIG. 3B is a front view of the working chamber according to FIG. 3A with linear and rotational drives for the tool spindles.

As can be seen from FIG. 3B, each tool spindle 30,30'; 31, 31' passes through the chamber housing 11 of the working chamber 10 to the outside.

Outside the working chamber 10, a base plate 32 is provided with an upper side 32*a* and a lower side 32*b*.

The base plate 32 is fixed in a manner known per se to a base frame of the apparatus 1 (not shown).

On the upper side 32*a* of the base plate 32, the respective devices 47, 48 for rotational and/or linear drive for the upper pair of tool spindles 30, 30' are provided.

On the lower side 32*b* of the base plate 32, the respective devices 47', 48' for rotational and/or linear drive for the lower pair of tool spindles 31, 31' are provided.

The respective devices 47, 47', 48, 48' are arranged substantially mirrored to each other along the base plate 32 as a mirror plane.

A pair of guide rails 33, 33'; 34, 34', is mounted on both the upper side 32*a* and the lower side 32*b* of the base plate 32.

On the upper pair of guide rails 33, 33' an upper slide 35 of substantially trough-shaped cross-section is provided, while on the lower pair 34, 34' of guide rails a lower slide 36 of substantially trough-shaped cross-section is provided.

Both slides 35, 36 are arranged on the respective pair of guide rails 33, 33' or 34, 34' so as to be movable in the Z direction of the apparatus 1. For this purpose, upper or lower guide carriages 37, 37'; 38, 38', in the exemplary embodiment guide carriages mounted on rolling bearings, are arranged in a manner known per se between the respective slides 35, 36 and the respective associated guide rails 33, 33' or 34, 34'.

A holder 39, 39' with a toothed rack 41, 41' fixed thereto is provided on each slide 35, 36. Each toothed rack 41, 41' meshes with a corresponding toothed wheel 42, 42'. Each toothed wheel 42, 42' is rotationally connected to a motor 43, 43' known per se.

This structure has the effect that, in the exemplary embodiment, each pair of tool spindles 30, 30' and/or 31, 31' is arranged so as to be synchronously movable along the Z-axis of the apparatus 1.

Furthermore, the mirror-symmetrical construction due to the base plate 32 serving as a mirror plane allows to provide only the upper pair of tool spindles 30, 30' or all two pairs of tool spindles 30, 30' and 31, 31', depending on the customer's requirements, without having to extensively rebuild the apparatus 1.

The preferred modular structure of the apparatus 1 is further accompanied, as can be seen from FIG. 3B, by a corresponding arrangement of X, Y and Z axes and the B axis of the apparatus 1.

As described above, the spindle housing 21 with the workpiece spindles 20, 20' received thereon is linearly movable along the X-axis of the apparatus 1 as well as pivotable about the B-axis of the apparatus 1. The pair or the at least two pairs of tool spindles 30, 30'; 31, 31' are linearly movable along the Z-axis of the apparatus 1.

The described arrangement of the axes with respect to each other allows that, for example, in the exemplary embodiment the pair of tool spindles 30, 30' can serve a pre-polishing of the optical workpieces 9, while the pair of tool spindles 31, 31' can serve a post-polishing of the optical workpieces 9. This requires that the tool spindles 30, 30'; 31, 31' and/or the processing tools 320 received thereon can be adequately advanced/fed or moved in the direction of the workpiece spindles 20, 20' and/or the optical workpieces 9 received thereon.

Therefore, the linear movement of the spindle housing 21 along the X-axis and the pivoting movement of the spindle housing 21 about the B-axis are selected such that the optical workpieces 9 can be brought into a position optimized for the infeed or advancing movement of the tool spindles 30, 30'; 31, 31'. At the same time, the X-axis lift and/or the B-axis swivel are minimized, so that the apparatus 1 has a particularly compact construction.

Figure 3C:
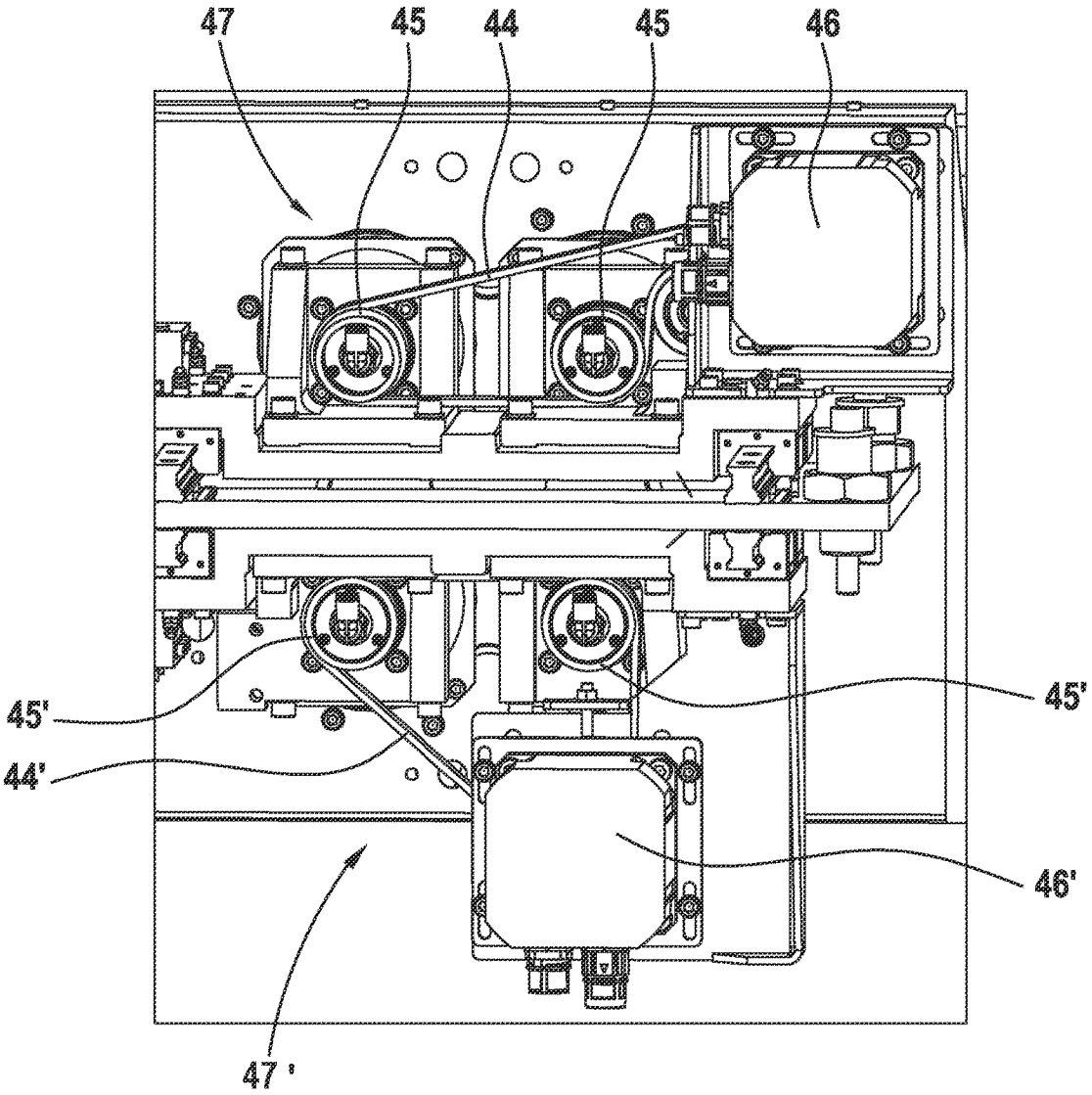
FIG. 3C is a partial view of FIG. 3B with linear and rotational drives for the tool spindles.

FIG. 3C shows the devices 47, 47' for rotational drive of each pair of tool spindles 30, 30'; 31, 31'. Each of these devices 47, 47' has a belt 44, 44', in particular a V-ribbed belt, which revolves around pulleys 45, 45' arranged on the tool spindles 30, 30'; 31, 31' and is driven by a motor 46, 46'. This arrangement ensures that each pair of tool spindles 30, 30' and/or 31, 31' is synchronously driven in rotation.

Similarly, the apparatus 1 can be easily equipped with either one pair of tool spindles 30, 30' or two pairs of tool spindles 30, 30'; 31, 31' without the need for extensive reconstructions.

Figure 4A:
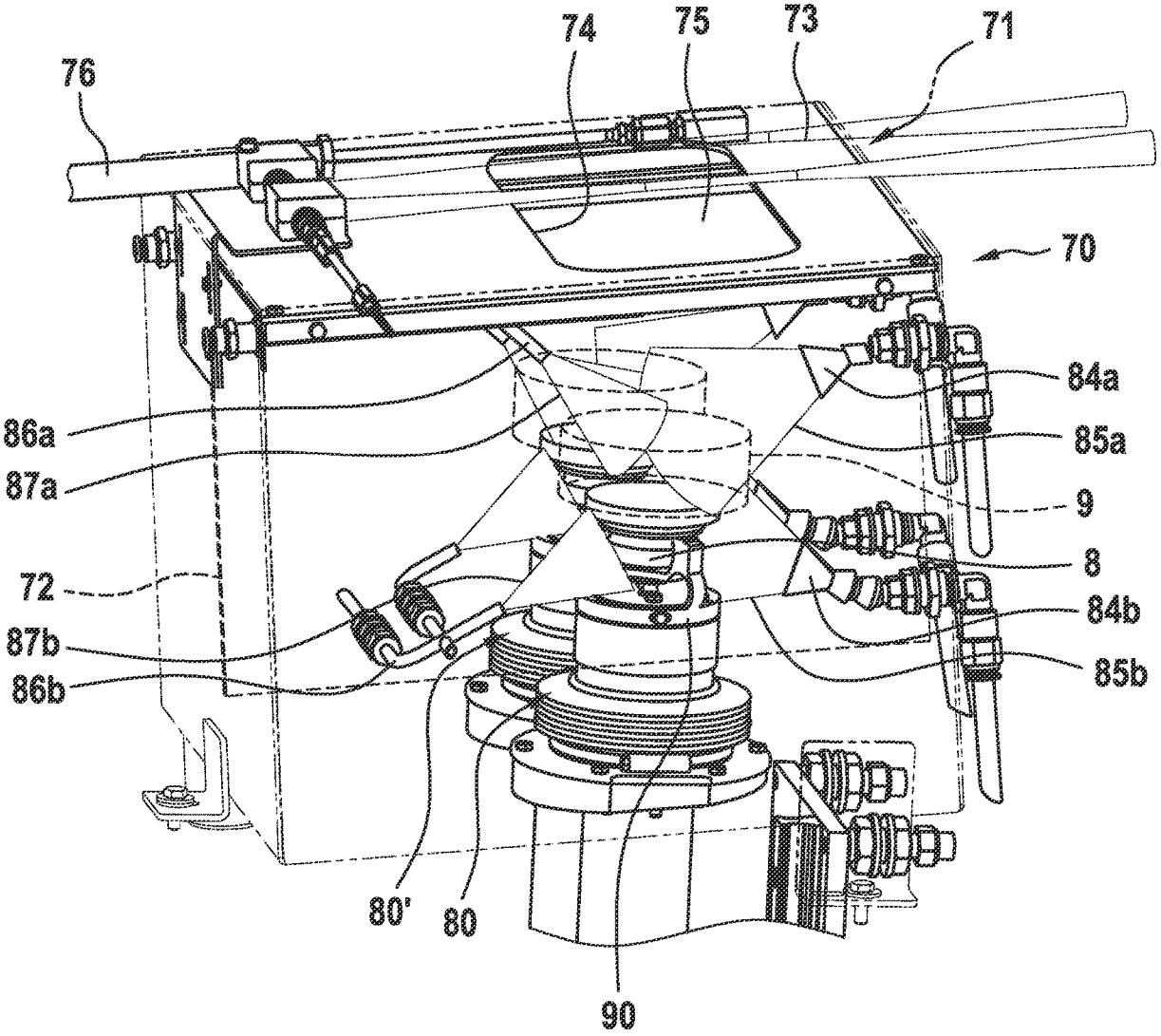
FIG. 4A is a perspective view of an exemplary embodiment of a cleaning station of the apparatus according to FIG. 1 in a cleaning position.
Figure 4B:
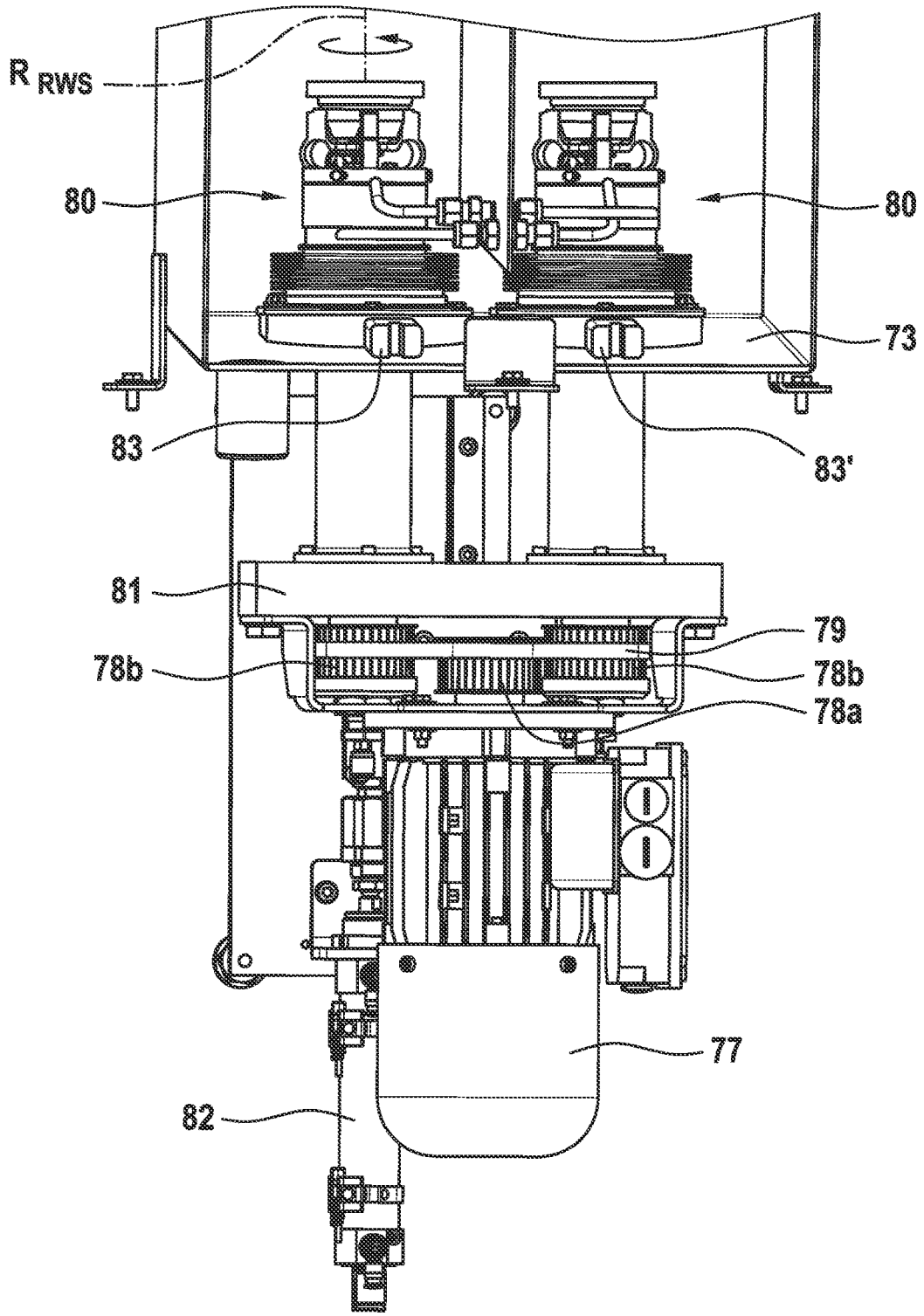
FIG. 4B is a detailed front view of the cleaning station according to FIG. 4A in a loading or unloading position.

Outside the working chamber 10, preferably in the direction of the Y-axis of the apparatus 1 (see also FIG. 2), a cleaning station 70 is arranged, as shown in FIGS. 4A and 4B. However, other arrangements are possible as well. For example, the cleaning station 70 may be arranged between the working chamber 10 and the conveying device 4.

The cleaning station 70 has a housing 71 in which a vertically extending partitioning wall 72 is provided.

The housing 71 further has a cover plate 73 with a recess 74, which is closable by means of a lid 75 movable via a hydraulic or preferably pneumatic cylinder 76.

Two workpiece spindles 80, 80' are arranged to the left and right of the partitioning wall 72 for receiving a pair of finished processed optical workpieces 9. In the exemplary embodiment shown, the optical workpieces 9 are finished polished lenses blocked on a block piece 8 in a manner known per se.

The partitioning wall 72 shall prevent mutual contamination of the optical workpieces 9 during the cleaning process.

In FIG. 4A, the workpiece spindles 80, 80' are shown in their lower position with respect to the X axis of the apparatus 1, i.e., in their cleaning position. The optical workpieces 9 to be cleaned should be arranged as far away as possible from the cover plate 73 in order to avoid contamination by splash water.

In FIG. 4B, the workpiece spindles 80, 80' are shown in their upper position with respect to the X axis of the apparatus 1, i.e., in their loading and/or unloading position. In this position, the optical workpieces 9 protrude from the recess 74 of the cover plate 73 so that the workpiece spindles 80, 80' can be loaded with optical workpieces 9 to be cleaned and/or cleaned optical workpieces 9 can be removed from the workpiece spindles 80, 80' (see below).

FIG. 4B shows a detailed front view of the interior of the cleaning station 70 according to FIG. 4A. This view shows that the workpiece spindles 80, 80' are rotatable about their respective rotation axis $R_{RWS}$ by means of a motor 77 via three pulleys 78*a*, 78*b* and a V-ribbed belt 79. Here, only the pulley 78*a* is driven directly by the motor 77, while the two pulleys 78*b*, which drive the workpiece spindles 80, 80', are driven passively via the V-ribbed belt 79.

It can further be seen from FIGS. 4A, 4B that a base plate 81 is provided, wherein the workpiece spindles 80, 80' are arranged on the upper side of the base plate 81 in the direction of the X-axis and the pulleys 78*b* are arranged on the corresponding lower side of the base plate 81 and are operatively connected to each other.

In addition, it can be seen from FIGS. 4A, 4B that a lifting cylinder 82, which operates pneumatically in the exemplary embodiment, is provided below the base plate 81, which in a manner known per se effects the aforementioned height adjustment of the workpiece spindles 80, 80' along the X axis of the apparatus 1.

Finally, it can be seen from FIG. 4B that sensors 83, 83' are assigned to the workpiece spindles 80, 80' (e.g. reflection light scanners known per se), which detect loading errors on the workpiece spindles 80, 80'.

Here, one aspect is that the optical workpieces 9 are cleaned in a two-stage method. The first stage is a washing process and the second stage is a drying process.

FIG. 4A shows that only two cleaning fluid nozzles 84*a*, 84*b* are provided per workpiece spindle 80, 80' and thus per optical workpiece 9.

The upper cleaning fluid nozzle 84*a* with respect to the X-axis of the apparatus 1 is arranged essentially in the circumferential region and slightly above the optical workpiece 9.

The cleaning fluid jet 85*a* (usually a water jet) emitted from the upper cleaning fluid nozzle 84*a* sweeps over and thus cleans the polished optical surface and the peripheral surface of the optical workpiece 9.

The lower cleaning fluid nozzle 84*b* with respect to the X-axis of the apparatus 1 is arranged substantially at the level/height of the transition region between the optical workpiece 9 and the block piece 8.

The cleaning fluid jet 85*b* (usually a water jet) emitted from the lower cleaning fluid nozzle 84*b* sweeps over and thus cleans the block piece 8 as well as the surface of the optical workpiece 9 projecting from the block piece 8.

In the exemplary embodiment, the workpiece spindles 80, 80' with the optical workpieces 9 rotate at about 50 rpm during this cleaning process to ensure thorough cleaning along the entire circumferential surfaces of optical workpieces 9 and block pieces 8.

The subsequent drying process initially consists of dry spinning of optical workpieces 9 and block pieces 8 at a rotation of the workpiece spindles 80, 80' of 500 rpm in the exemplary embodiment. Here, the cleaning agent adhering to the optical workpieces 9 and block pieces 8 is spun away due to the centrifugal force acting on it.

However, a drop of water remains in the center of the polished optical surface of the optical workpieces 9, since the optical surfaces are usually concave and thus no centrifugal force acts in this area. In addition, the cleaning agent accumulated in the rear cavity of the block piece 8, which is known per se, cannot be removed. Instead, residues of cleaning agent remain on the rear inner wall of the block piece 8.

To complete the drying process, two compressed air nozzles 86*a*, 86*b* are associated with each workpiece spindle 80, 80' and/or the blocked lens 9 received thereon.

The compressed air nozzles 86*a* are arranged in such a way that a discharged compressed air pulse 87*a* is directed to the center of the usually concave polished optical surface of the optical workpiece 9, so that the water drop remaining there is removed.

The compressed air nozzles 86*b* are arranged such that a discharged compressed air pulse 87*b* is directed to the inner wall of the hollow rear side of the respective block piece 8, so that the inner wall is blown dry from below.

Figure 4C:
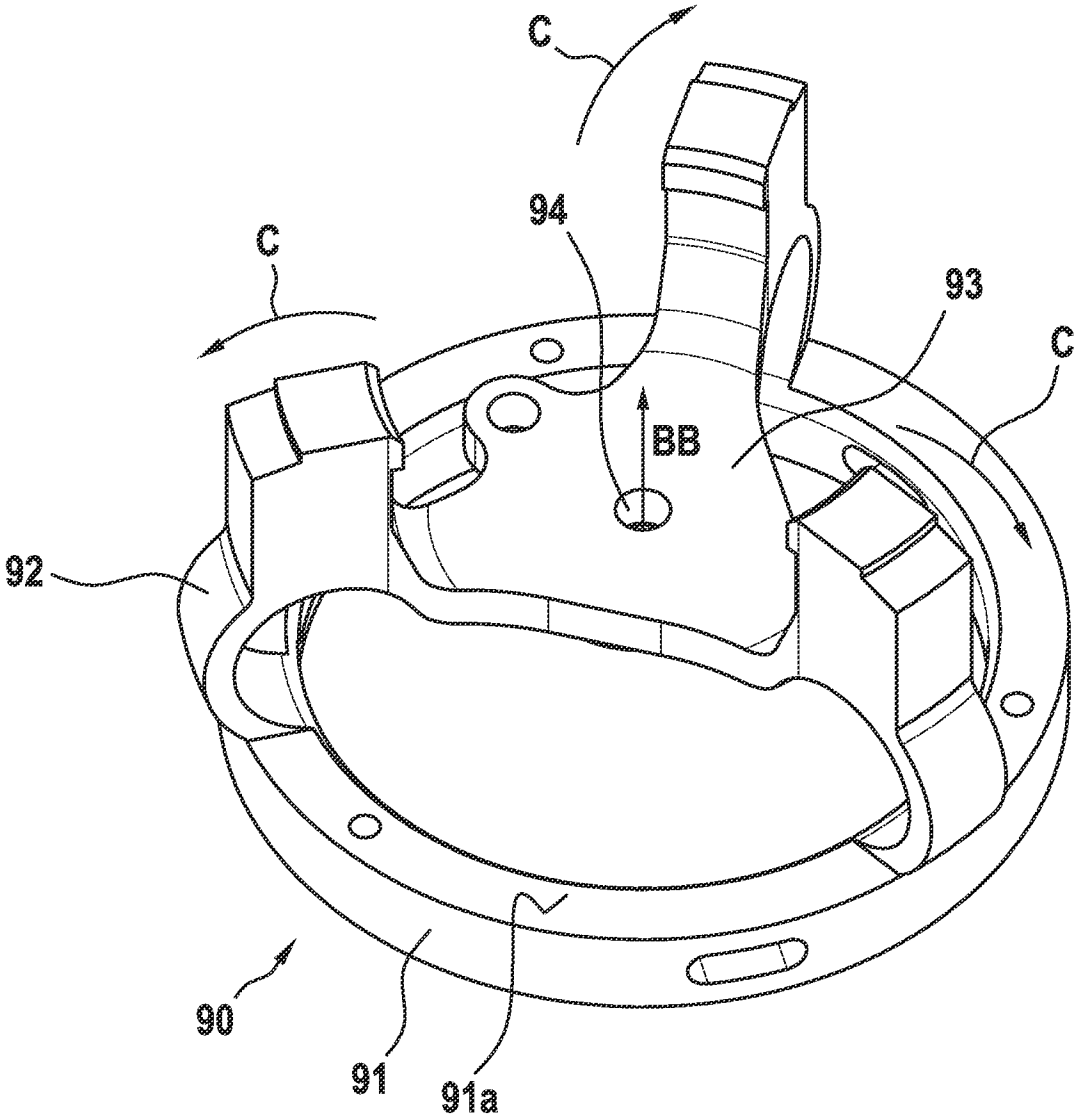
FIG. 4C is an exemplary embodiment of a clamping ring or collet for the workpiece spindles of the cleaning station according to FIG. 4A.

Another aspect is that each optical workpiece 9 is received by a collet chuck or collet 90 via its block piece 8. A detailed view of the collet 90 is shown in FIG. 4C.

In the exemplary embodiment, the collet 90 is formed in one piece, in particular injection molded from a suitable plastic.

The collet 90 has a retaining ring 91 which is received and fixed in a suitable recess at the free end of the workpiece spindles 80, 80' (not shown).

On the upper side 91*a* of the retaining ring 91 (with respect to the X-axis of the apparatus 1), three gripping elements 92 are arranged rotationally symmetrically, i.e. at a distance of 120°, respectively.

The three gripping elements 92 are integrally connected to the upper side 91*a* of the retaining ring 91 according to the principle of a flexure bearing or flexure hinge. The three gripping elements 92 are further integrally connected to an inner plate 93.

Figure 4D:
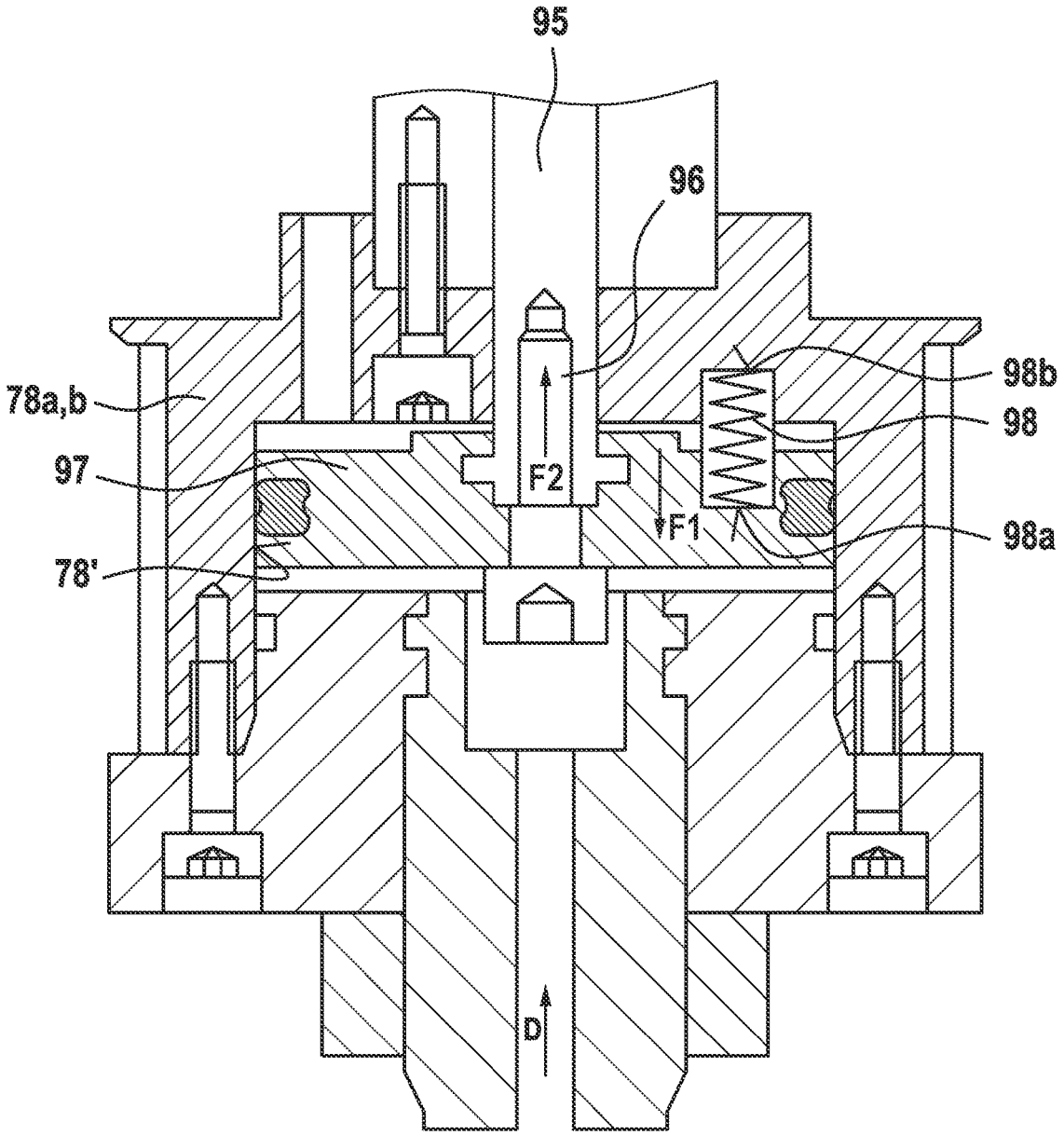
FIG. 4D is a detailed sectional view of the mechanism for pretensioning the clamping ring or collet according to FIG. 4C.

The inner plate 93 has a central opening 94 for receiving and fixing a lifting rod 95 (cf. FIG. 4D).

FIG. 4D shows that the lifting rod 95 is operatively connected to a lifting piston 96, which is pneumatic in the example. The lifting piston 96 is received in a piston plate 97. The piston plate 97 is received in a rear recess 78' of the pulley 78*a* or 78*b* so as to be displaceable along the X axis of the apparatus 1.

Three pressure springs or compression springs 98, which are rotationally symmetrically spaced from one another, bear on one side against a surface of a first receptacle 98*a* in the piston plate 97 and on the other side against a surface in a receptacle 98*b* in the pulley 78*a* or 78*b*.

In the illustrated relaxed state of the compression springs 98, a force acts on the piston plate 97 and thus on the lifting rod 95 in the direction of the arrow F1. When compressed air D is applied to the lifting piston 96, for example, a force acting in the opposite direction, in the direction of the arrow F2, is exerted on the piston plate 97 and thus on the lifting rod 95.

To load the collet 90 according to FIG. 4C, a force is applied to the lifting piston 96 as described in a manner known per se. This force acts via the lifting rod 95 in the direction of the arrow BB on the inner plate 93 in such a way that the inner plate 93 is lifted.

As a result, the gripping elements 92 are pressed outward in the direction of the arrows C. In this position, the collet 90 is open so that it can receive the underside of a block piece 8 on which an optical workpiece 9 is blocked.

Subsequently, the force is removed so that the lifting piston 96 and the lifting rod 95 return to their initial position according to FIG. 4D and the collet 90 resumes its closed position in such a way that the gripping elements 92 engage in the block piece 8. The block piece 8 is then fixed positively or fixed in a form-fit manner to the collet 90.

In a manner known per se, the apparatus 1 requires a device 50 for tool inspection in order to be able to detect damage or even total loss of a processing tool 320.

Figure 5:
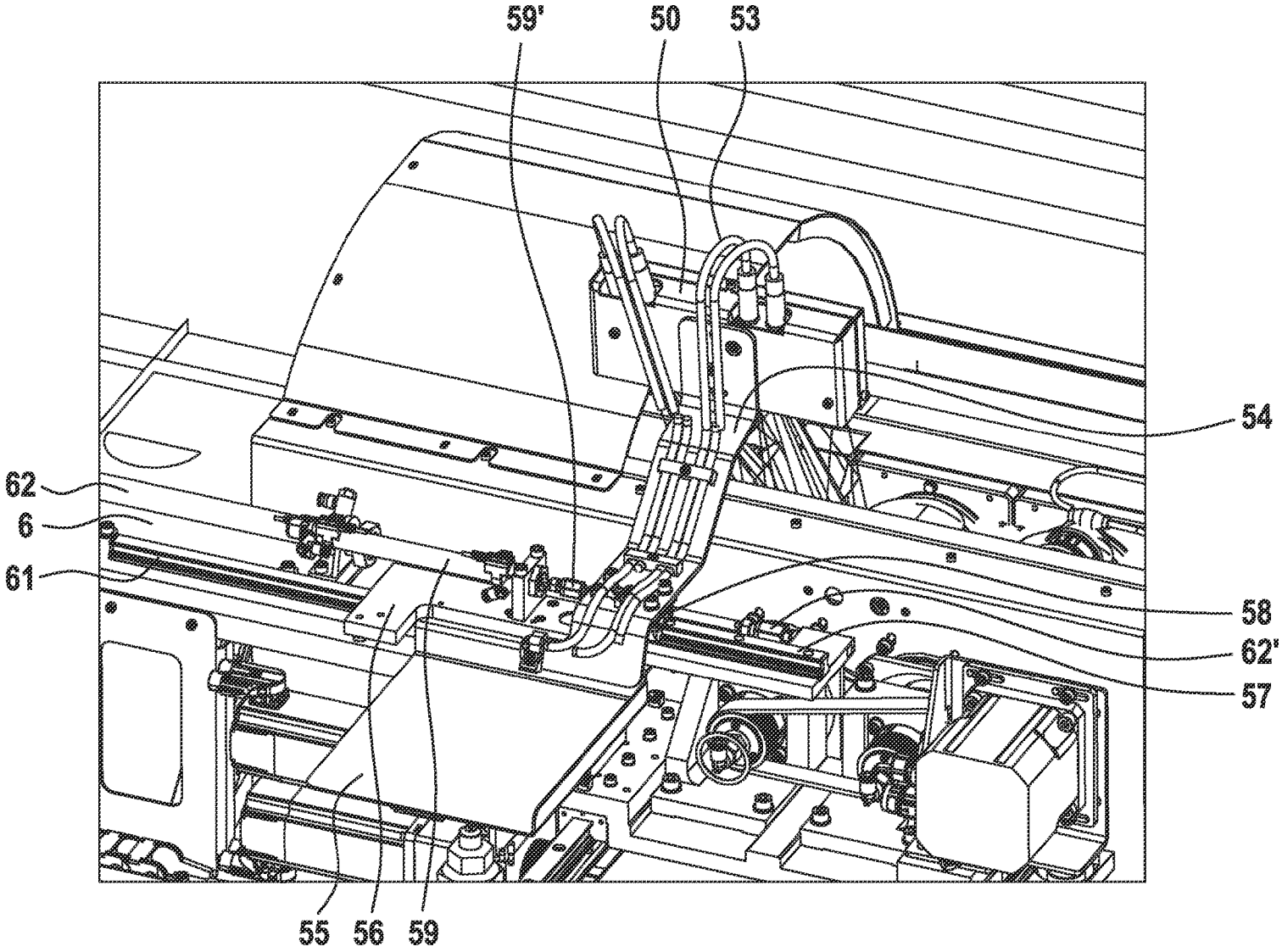
FIG. 5 is an exemplary embodiment of a device for tool inspection for the apparatus according to FIG. 1.

A proposed device 50 for tool inspection according to FIG. 3A and FIG. 5 comprises two laser scanners (not shown). Each laser scanner emits a two-dimensional fanned-out laser beam 51, 52. Here, one upper and one lower processing tool 320 are inspected simultaneously.

The laser beam 51 is configured to inspect the processing tools 320 received on the upper tool spindles 30, 30'. For this purpose, the laser beam 51 runs essentially perpendicular to the Y-Z plane of the apparatus 1 and is inclined backwards by 5° with respect to the X axis.

The laser beam 52 is configured to inspect the processing tools 320 received on the lower tool spindles 31, 31'. For this purpose, the laser beam 52 runs obliquely to the X axis in such a way that, unobstructed by the upper tool spindles 30, 30' and the processing tools 320 received thereon, the processing tools 320 received on the lower tool spindles 31, 31' can be inspected. The laser beam 52 is also inclined backwards by 5°.

For evaluation of the measurement results, a light section sensor is assigned to each laser beam in a manner known per se.

The laser beams 51, 52 are arranged in such a way that they hit the tools to be detected exclusively in a radial orientation (cf. FIG. 3A). This means that only the peripheral surfaces of the processing tools 320 to be inspected are detected by the laser beams, but not their front surfaces. By rotating the tool spindles 30, 30'; 31, 31' and thus rotating the processing tools 320 during the measurement, a coverage is obtained over the entire inspected circumferential surface of the processing tools 320.

In the exemplary embodiment, the processing tools 320 are polishing tools for optical lenses. Such processing tools 320 consist in principle, in a manner known per se, of a base body, an intermediate foam layer and a polishing foil, which usually protrudes from the intermediate foam layer. Accordingly, the laser beams 51, 52 cover the circumferential surface of the base body, the circumferential surface of the intermediate foam layer, the circumferential edge of the polishing foil and the rear side of the protruding polishing foil (since the laser beams 51, 52 are inclined backwards by 5°).

In this exemplary embodiment, cracks and other damage in the intermediate foam layer as well as cracks and other damage at the peripheral edge of the polishing foil can be detected, as well as the total loss, i.e. tearing off of the processing tool 320. A particular advantage is that the inspection of the processing tools 320 can now detect defects in the intermediate foam layer and thus prevent a total loss of the processing tool 320, since the processing tool 320 can be changed in good time before the total tear-off of the intermediate foam layer.

It can be seen from FIG. 5 that the device 50 for tool inspection, together with its cabling 53, is fixed to a retaining element 54, which in turn engages with a retaining plate 55.

The retaining plate 55 is connected to a carrier element 56, which is overlapped by the retaining element 54 and onto which a profile rail or guide rail 57 is fixed.

A guide carriage 58, preferably a guide carriage mounted on rolling bearings, is fixed to the underside of the retaining element 54, which guide carriage 58 engages in the profile rail 57.

The guide carriage 58 is operatively connected to a pneumatic or hydraulic cylinder 59 via a connecting element 59'. This allows the device 50 to be moved in a sliding manner on the profile rail 57 along the Y-axis of the apparatus 1.

In the exemplary embodiment, the travel distance is 130 mm; this corresponds to the distance between the center axes $M_{WZ}$ of the tool spindles 30, 30'; 31, 31'.

Below the carrier element 56, a further profile rail or guide rail 61 is fixed to a component 6 of the machine frame in a manner known per se. A further guide carriage is also fixed below the carrier element 56 (not shown).

The carrier element 56 is operatively connected to a pneumatic or hydraulic cylinder 62 via a connecting element 62'. Thus, the device 50 can be moved together with the carrier element 56 on the profile rail 61 along the Y-axis of the apparatus 1. In this way, the device 50 can be brought into a retracted position in such a way that the working space 12 of the working chamber 10 is freely accessible, for example, for necessary tool changes and/or maintenance work.

Figure 6A:
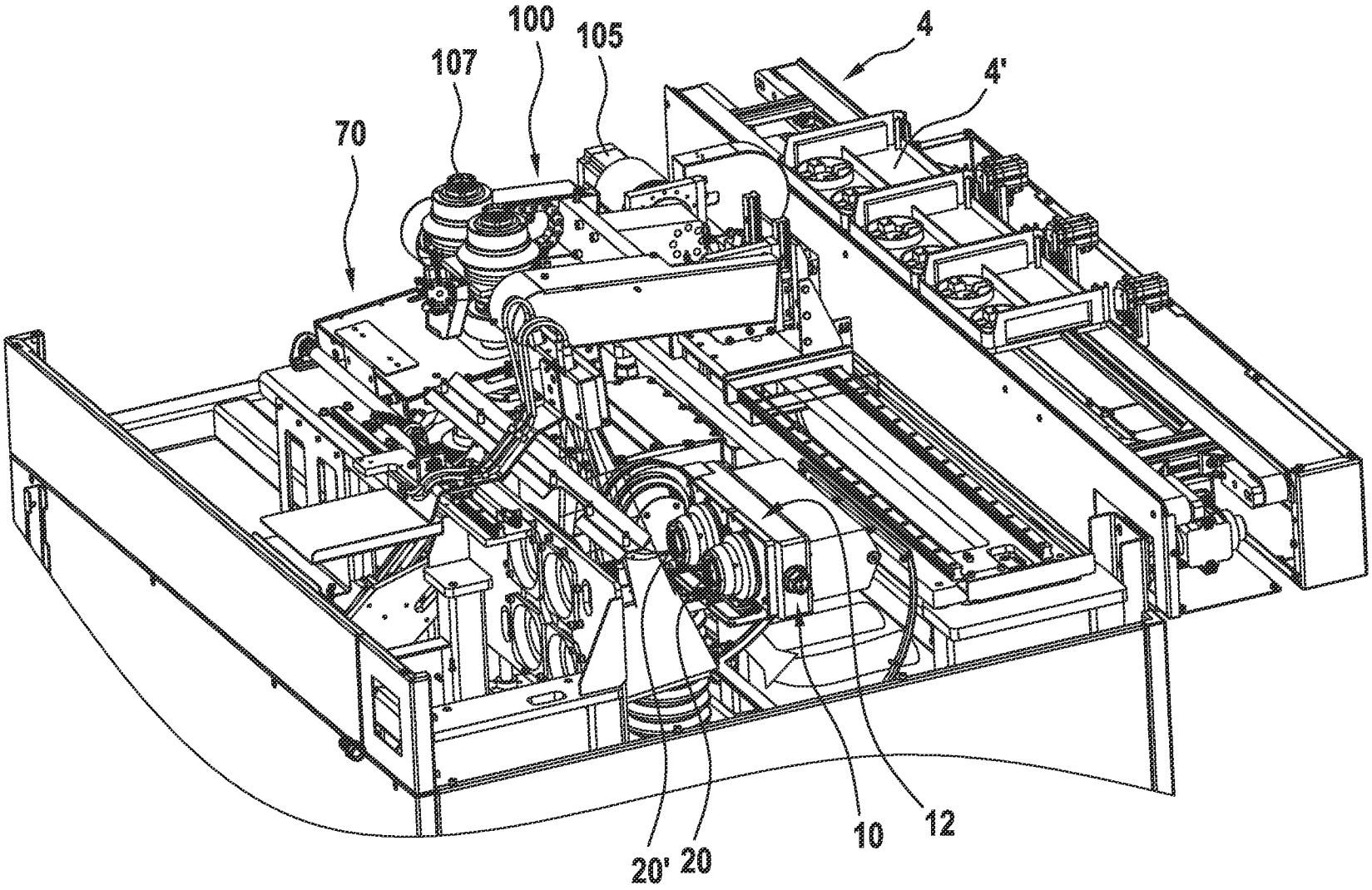
FIG. 6A is a perspective top view of the apparatus according to FIG. 2.
Figure 6B:
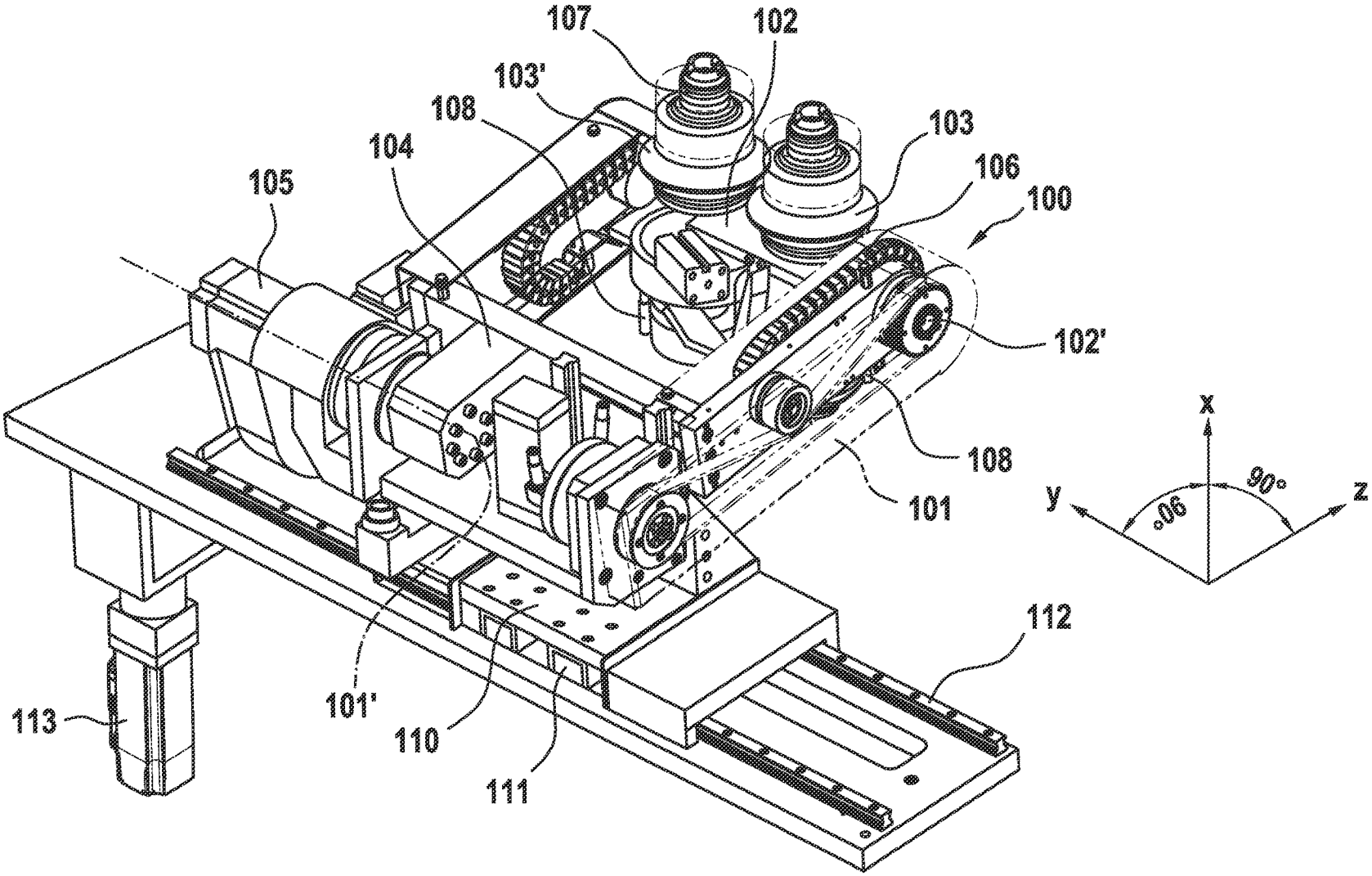
FIG. 6B is a perspective view of an exemplary embodiment of a handling device of the apparatus according to FIG. 6A.

For handling the optical workpieces 9, in particular for transporting them into and out of and/or within the apparatus 1, a handling device 100 is provided, as shown in FIG. 6A and in particular FIG. 6B. The handling device 100 is essentially known from WO 2012/126604 A2, to the disclosure of which reference is made.

As can be seen from FIG. 6A, a conveyor device 4 runs along the apparatus 1 for transporting optical workpieces 9 and/or conveying containers 4' in which the optical workpieces 9 are accommodated. Basically, optical workpieces 9 to be processed are fed to the apparatus 1 by means of the conveyor device 4, and finished processed optical workpieces 9 are conveyed out of the apparatus 1 and further conveyed.

The conveyor device 4 can be an independent component or an integral component of the apparatus 1.

In the exemplary embodiment, the conveyor device 4 is suitable for integrating the apparatus 1 into a system for processing optical lenses with a plurality of separate processing devices, such as is known, for example, from EP 2 822 883 B1.

In the exemplary embodiment, the conveyor device 4 is designed as a transport belt or belt conveyor.

The handling device 100 serves to pick up or receive optical workpieces 9 in pairs at the conveyor device 4, preferably from the conveying container 4' assigned to the optical workpieces 9, to feed them to the working space 12 of the working chamber 10 and to load the workpiece spindles 20, 20'.

The handling device 100 further serves to remove finished polished optical workpieces 9 from the working space 12 of the working chamber 10 and/or from the workpiece spindles 20, 20', to transport them to the cleaning station 70 and to load the workpiece spindles 80, 80' thereof.

Finally, the handling device 100 serves to remove cleaned optical workpieces 9 from the cleaning station 70 or from its workpiece spindles 80, 80' and to transport them back to the conveyor device 4 (and preferably to deposit them in the corresponding conveying container 4').

The illustration in FIG. 6A shows the handling device 100 loading the cleaning station 70 and/or removing the cleaned optical workpieces 9 from the cleaning station 70.

Conveniently, the handling device 100 is arranged between the conveyor device 4 and the working chamber 10 or the cleaning station 70.

The structure of the handling device 100 can be seen in particular in FIG. 6B. The handling device 100 has a substantially U-shaped swivel arm 101, to the cross strut 102 of which two holding devices 103, 103' are attached.

The swivel arm 101 is mounted by means of a holding arm 104 on a swivel axis 101' so as to be pivotable about the Y-axis of the apparatus 1.

The cross strut 102 is also mounted on a swivel axis 102' so as to be pivotable about the Y-axis of the apparatus 1.

In the exemplary embodiment, the handling device 100 further comprises a swivel drive 105 for swiveling the swivel arm 101 via a belt drive 106, as indicated in FIGS. 6A and 6B. The swiveling of the swivel arm 101 is performed by means of the belt drive 106 in a manner known per se in such a way that during the swiveling process the holding devices 103, 103' always remain perpendicular or vertical, that is, are always aligned parallel to the X-axis of the apparatus 1.

In a manner known per se, each holding device 103, 103' has on opposite sides a first receiving device or pick-up device 107, in the example in the form of a suction cup, and a second receiving device or pick-up device 108, in the example in the form of a 4-finger gripper.

The first pick-up device 107 is always used for handling, at the center, optical workpieces 9 still to be processed, while the second pick-up device 108 is used for handling, at the edge, optical workpieces 9 that have already been polished or polished and cleaned, thus finished processed optical workpieces 9.

The essential difference between the handling device 100 and the handling device known from WO 2012/126604 A2 is that the handling device 100 is designed to be displaceable or movable along the Y-axis or another axis, for example the Z-axis, of the apparatus 1, so that the handling device 100 can approach both the working chamber 10 and the cleaning station 70.

For this purpose, the handling device 100 is accommodated on a slide 110, which is arranged movably in a manner known per se by means of guide carriages 111, in the exemplary embodiment guide carriages mounted on rolling bearings, on guide rails 112.

A motor 113 serves expediently as the drive for the movement of the slide 110, e.g. along the Y-axis of the apparatus 1.

The guide rails 112 run parallel to the Y-axis of the apparatus 1 in the shown embodiment.

It is expedient that the slide 110, the guide carriages 111 and the guide rails 112 are protected in a manner known per se by means of a bellows (not shown) against contamination by any polishing agent that may have been carried away.

A further difference between the tool spindle known from EP 3 418 000 A1 and the proposed pairs of tool spindles 30, 30'; 31, 31' used is the design of a proposed tool holder 120 for a suitable proposed processing tool 320.

Figure 7A:
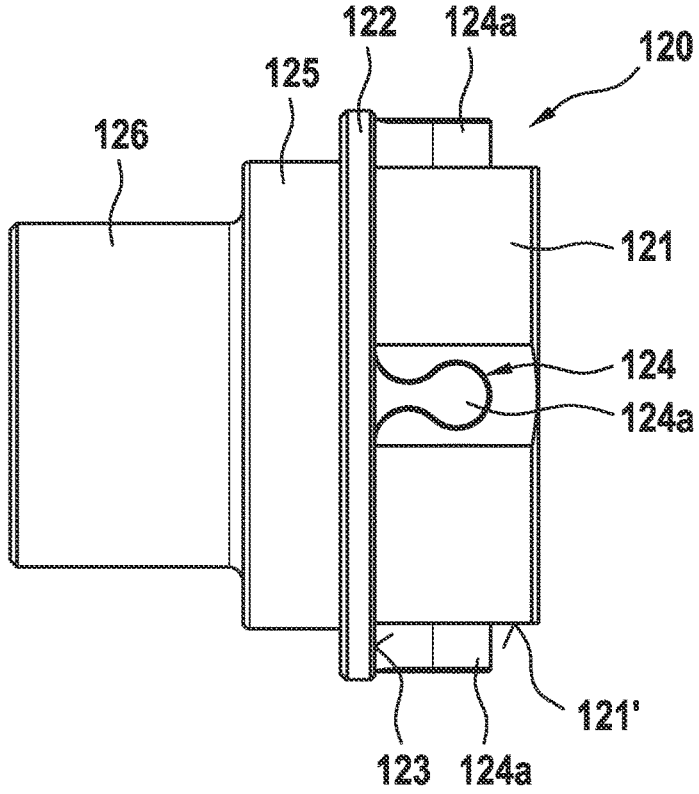
FIG. 7A is a side view of an exemplary embodiment of a proposed tool holder.
Figure 7B:
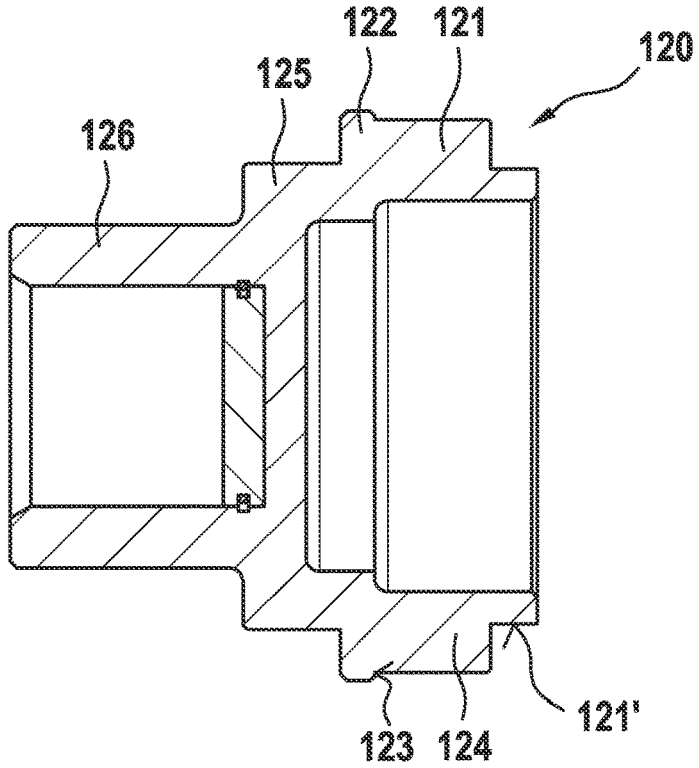
FIG. 7B is a longitudinal section through the tool holder according to FIG. 7A.

FIGS. 7A and 7B show an exemplary embodiment of a proposed tool holder 120.

The tool holder 120, which is formed integrally or as one piece, consists in the exemplary embodiment of an injection-molded plastic. A suitable plastic is, for example, PA 6.6 GF30 (polyamide made from hexamethylenediamine and adipic acid (nylon) with a glass fiber content of 30% by weight).

The tool holder 120 has an annular holder head 121 centered on a collar 122.

The diameter of the collar 122 is larger than the outer diameter of the holder head 121.

Four retaining lugs or retaining elements 124, each spaced 90° apart, are integrally formed on the resulting annular rim 123 and are integrally connected to the outer wall 121' of the holder head 121.

Each retaining lug or retaining element 124 has a substantially round retaining lug head or retaining element head 124*a*.

A substantially cylindrical extension 125 joins on the side of the collar 122 facing away from the holder head 121, which extension 125 merges into an annular holder body 126.

Figure 7C:
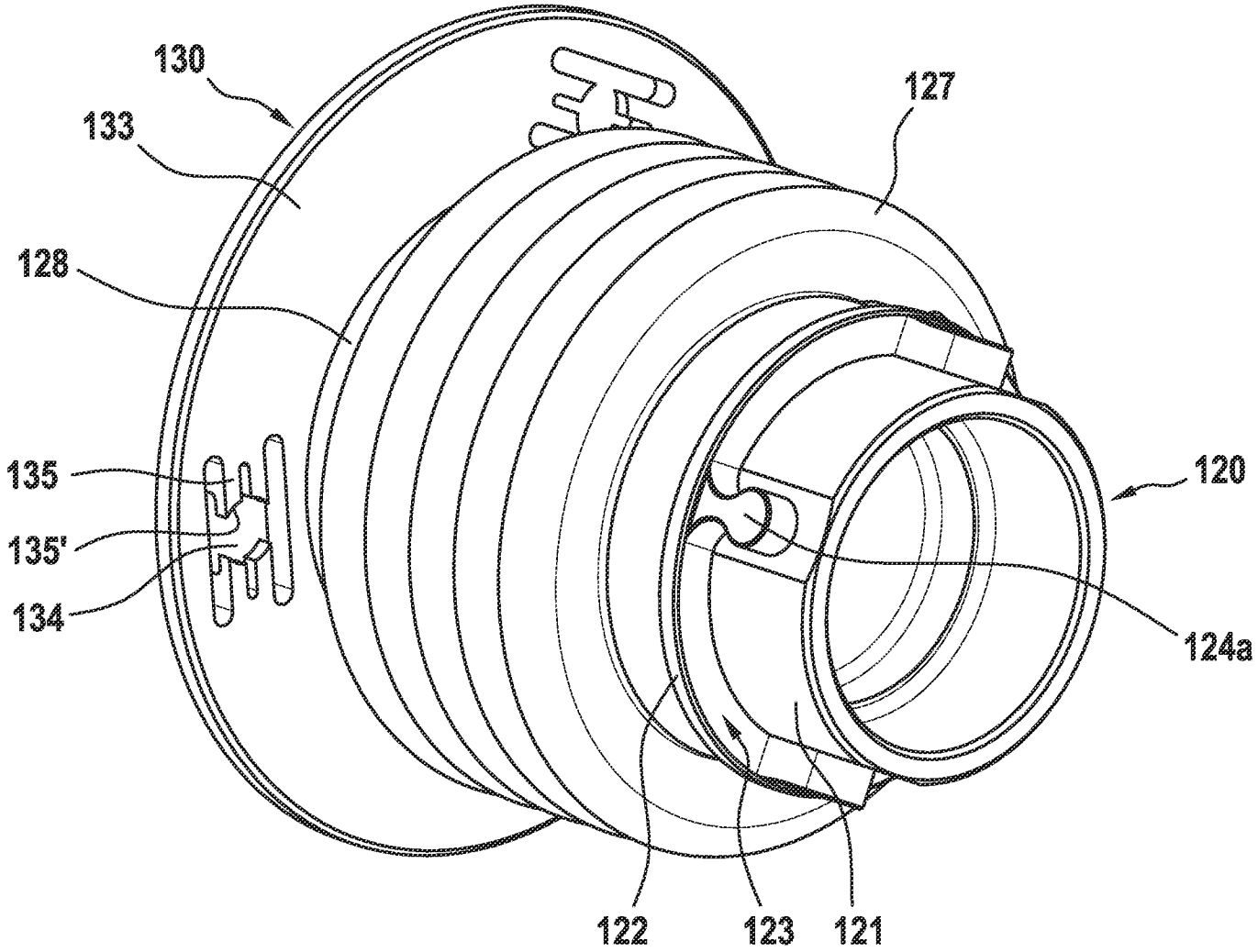
FIG. 7C is the tool holder according to FIG. 7A with bellows and spindle flange.
Figure 7D:
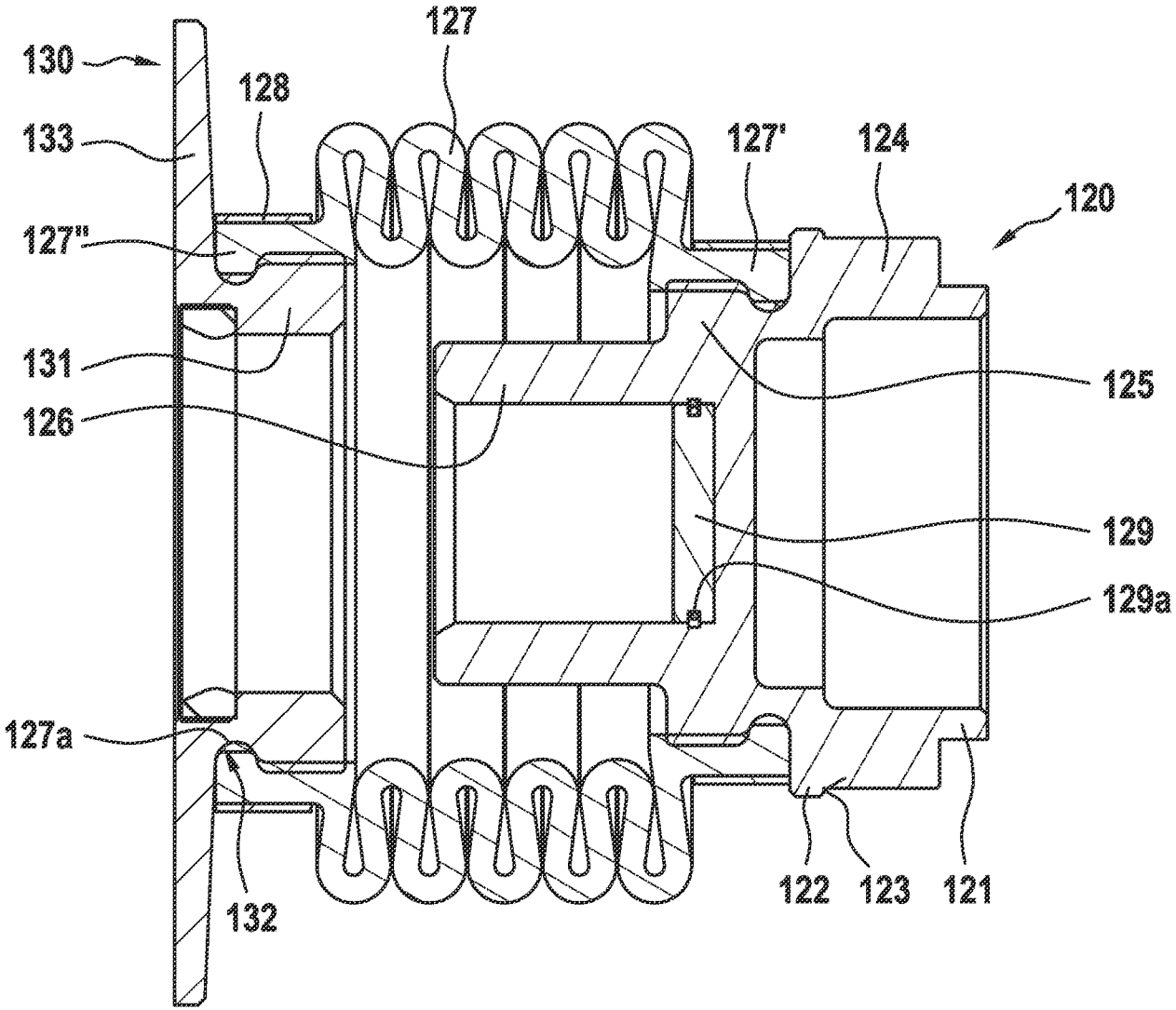
FIG. 7D is a longitudinal section through the tool holder with bellows and spindle flange according to FIG. 7C.

FIGS. 7C and 7D show the tool holder 120 in an embodiment ready for use in the apparatus 1, with a bellows 127, preferably made of a vulcanized rubber and, a spindle flange 130.

A first free end 127' of a conventional bellows 127 is vulcanized onto the cylindrical extension 125 in a manner known per se. The second free end 127" of the bellows 127 is fixed to a collar 131 of the spindle flange 130 by means of a clip or clamp 128.

When the second free end 127" is pulled onto the collar 131, the material of the bellows 127 is stretched so that the second free end 127" of the bellows 127 is firmly seated on the collar 131. The clamp 128 serves as an additional securing means of the resulting force-fit connection.

In FIG. 7D, it can be seen that an inner circumferential bead 127*a* is formed on the second free end 127" of the bellows 127 and that the bead 127*a* engages in an annular circumferential indentation 132 behind the collar 131, resulting in an additional form fit between the bellows 127 and the spindle flange 130.

FIG. 7D also shows that an internal disk 129 is held clamped in the holder body 126 of the tool holder 120 by means of an annular spring 129*a*. The disk 129 consists of a metallic material that can be attracted by a magnet.

The spindle flange 130 is also injection molded in one piece and consists in the exemplary embodiment of the same material as the tool holder 120. The spindle flange 130 further has an annular spindle disk 133 which adjoins the indentation 132. The spindle disk 133 has a substantially larger outer diameter than the collar 131.

Three recesses 134 are rotationally symmetrically formed in the spindle disk 133, each at a distance of 120°. Each recess 134 has two opposing pairs of spring elements 135. The free ends 135' of the spring elements 135 form an approximately circular outline.

Figure 7E:
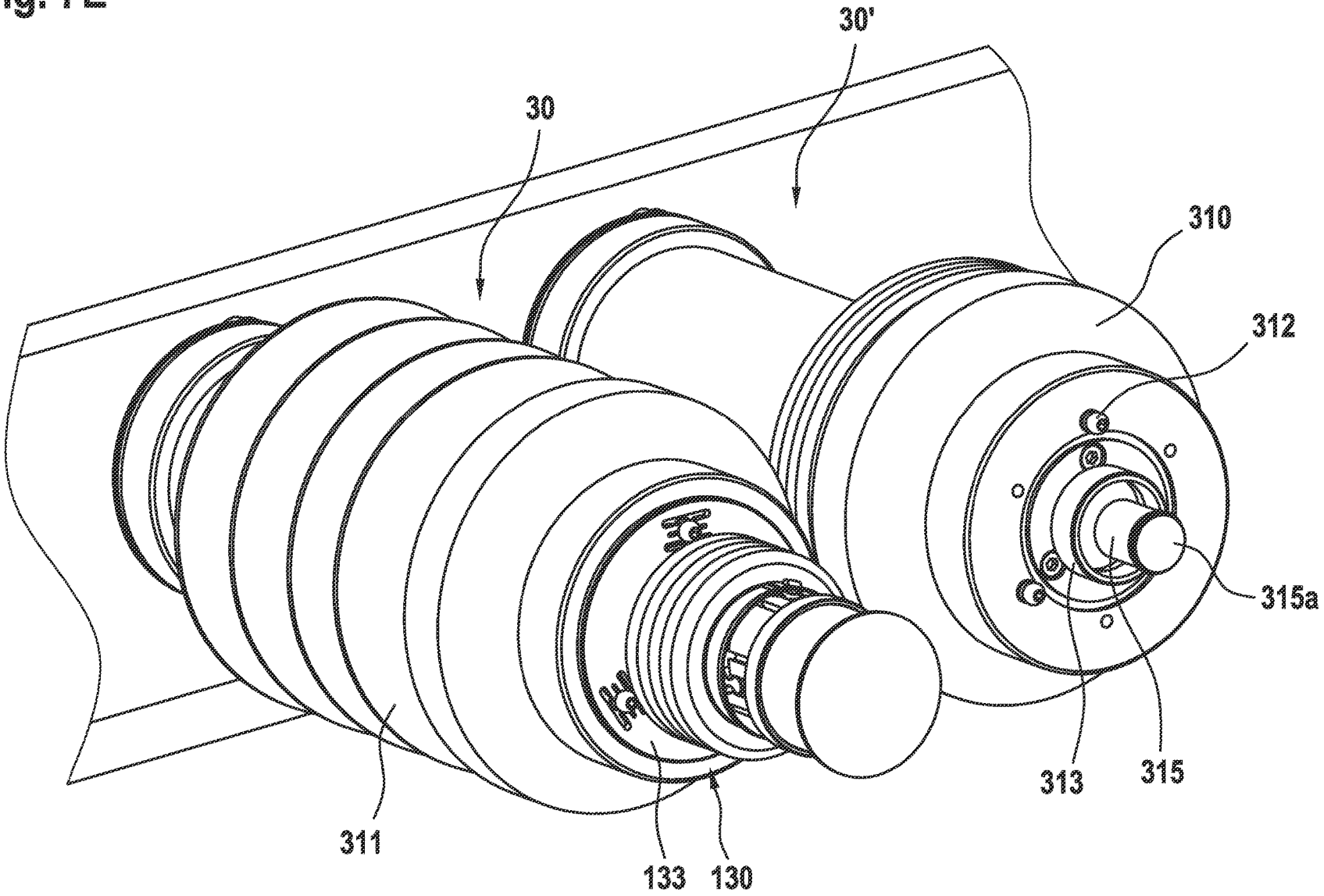
FIG. 7E is a perspective view of a pair of tool spindles with and without a processing tool.
Figure 7F:
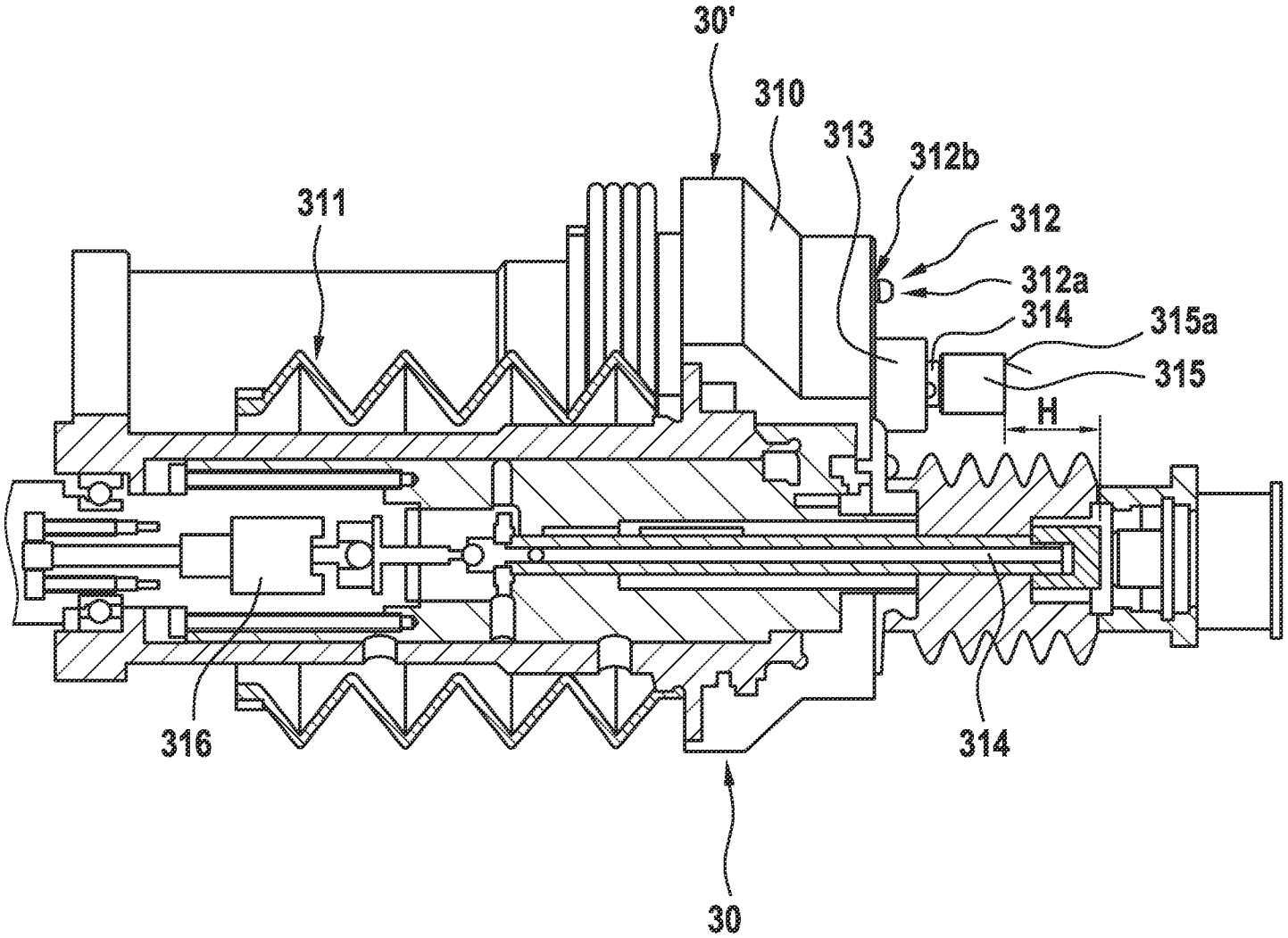
FIG. 7F is a longitudinal section through a tool spindle according to FIG. 7E with processing tool.

FIGS. 7E and 7F show two tool spindles 30, 30' of the apparatus 1, as already described above. It can be seen from FIGS. 7E and 7F that in each tool spindle 30, 30'; 31, 31' a lifting rod 314 is mounted in a spindle shaft 313 in a manner known per se, in such a way that the lifting rod 314 is arranged movably in the direction of the Z-axis of the apparatus 1. For this purpose, a lifting cylinder 316 is provided in each tool spindle 30, 30', 31, 31' in a manner known per se, which cylinder in the exemplary embodiment operates pneumatically and is operatively connected to the lifting rod 314.

In the exemplary embodiment, the lifting rod 314 has a maximum oscillation stroke H of 25 mm (cf. FIG. 7F).

FIGS. 7E and 7F further show that both the spindle shaft 313 and the lifting rod 314 protrude from the spindle head 310.

The lifting rod 314 serves in a manner known per se for an oscillating infeed or movement of the processing tool 320 received on each tool spindle 30, 30'; 31, 31' to the optical workpiece 9 during the processing.

The spindle head 310 covering the free end of the tool spindles 30, 30' is connected in a usual manner to a bellows 311. The plate-shaped free end of the spindle head 310 has three bolts 312, which are arranged rotationally symmetrically to one another at a distance of 120°, respectively. The bolts 312 have a bolt head 312*a* and an annular recess 312*b* located behind it.

A cap 315 is screwed onto the lifting rod 314 in a manner known per se, the free surface 315*a* of which is formed as a magnet (cf. EP 3 418 000 A1, the disclosure of which is expressly referred to).

FIG. 7E shows how the spindle disk 133 of the spindle flange 130 is fixed to the spindle head 310. The bolts 312 are guided through the recesses 134 made in the spindle disk 133. In the process, the spring elements 135 are bent up in the direction of the bellows 127 until each bolt head 312*a* passes through the corresponding recess. The spring elements 135 then snap back into their initial position and at the same time engage in the annular recess 312*b*, thus engaging behind the bolt head 312*a*. Thus, the spindle disk 133 of the spindle flange 130 is securely held on the spindle head 310.

In FIG. 7F it can be seen that when the spindle disk 133 is fixed to the spindle head 310, the lifting rod 314 with the cap 315 engages in the annular holder body 126 of the tool holder 120. In the process, the disk 129 is attracted by the magnet of the free surface 315*a* of the cap 315 until the two parts are connected to each other in a force-fitting manner. This facilitates the fixing of the spindle disk 133 to the spindle head 310 and contributes to a firm hold of the tool holder 120 on the tool spindle.

Figure 8A:
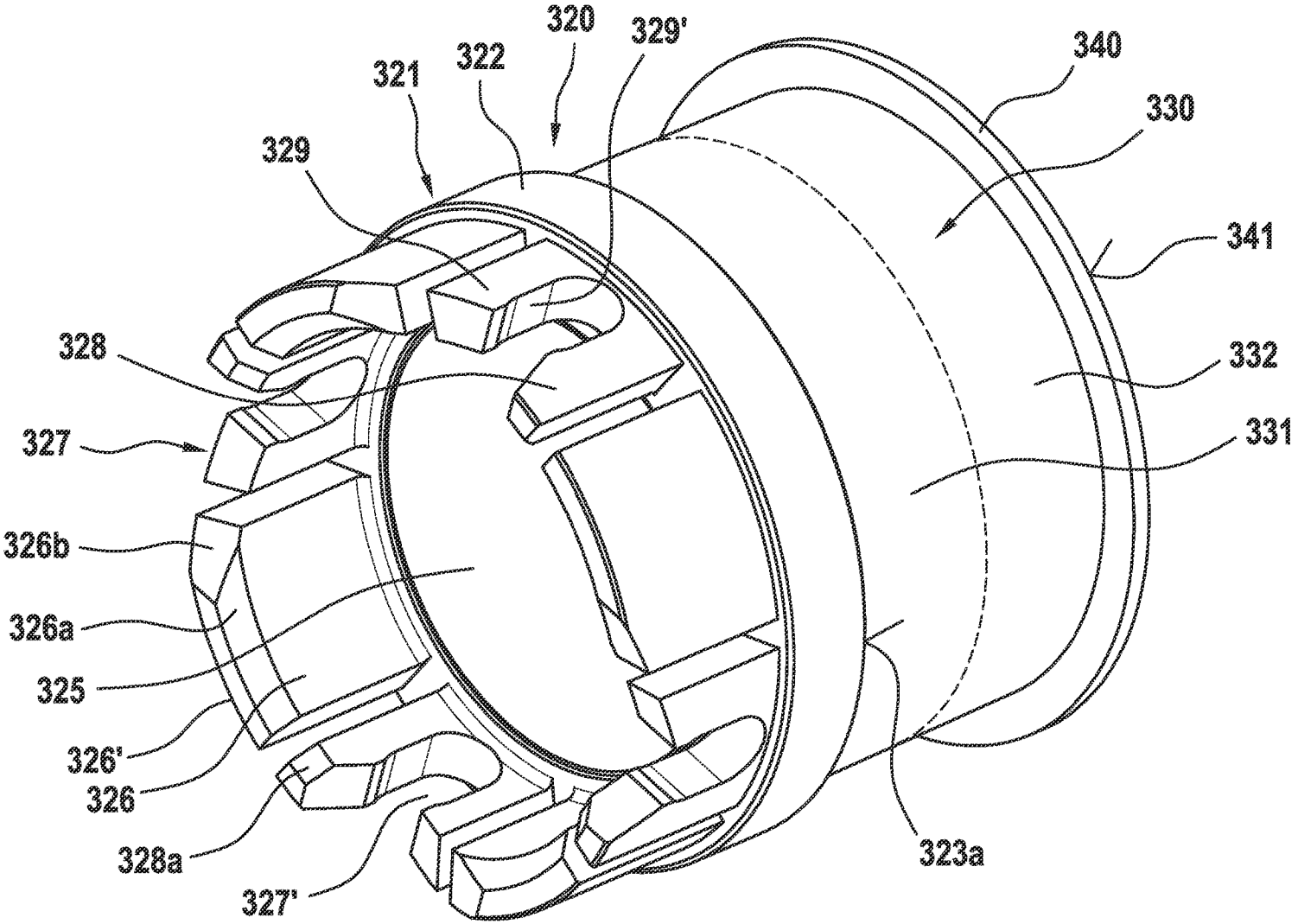
FIG. 8A is a perspective view of a proposed processing tool.
Figure 8B:
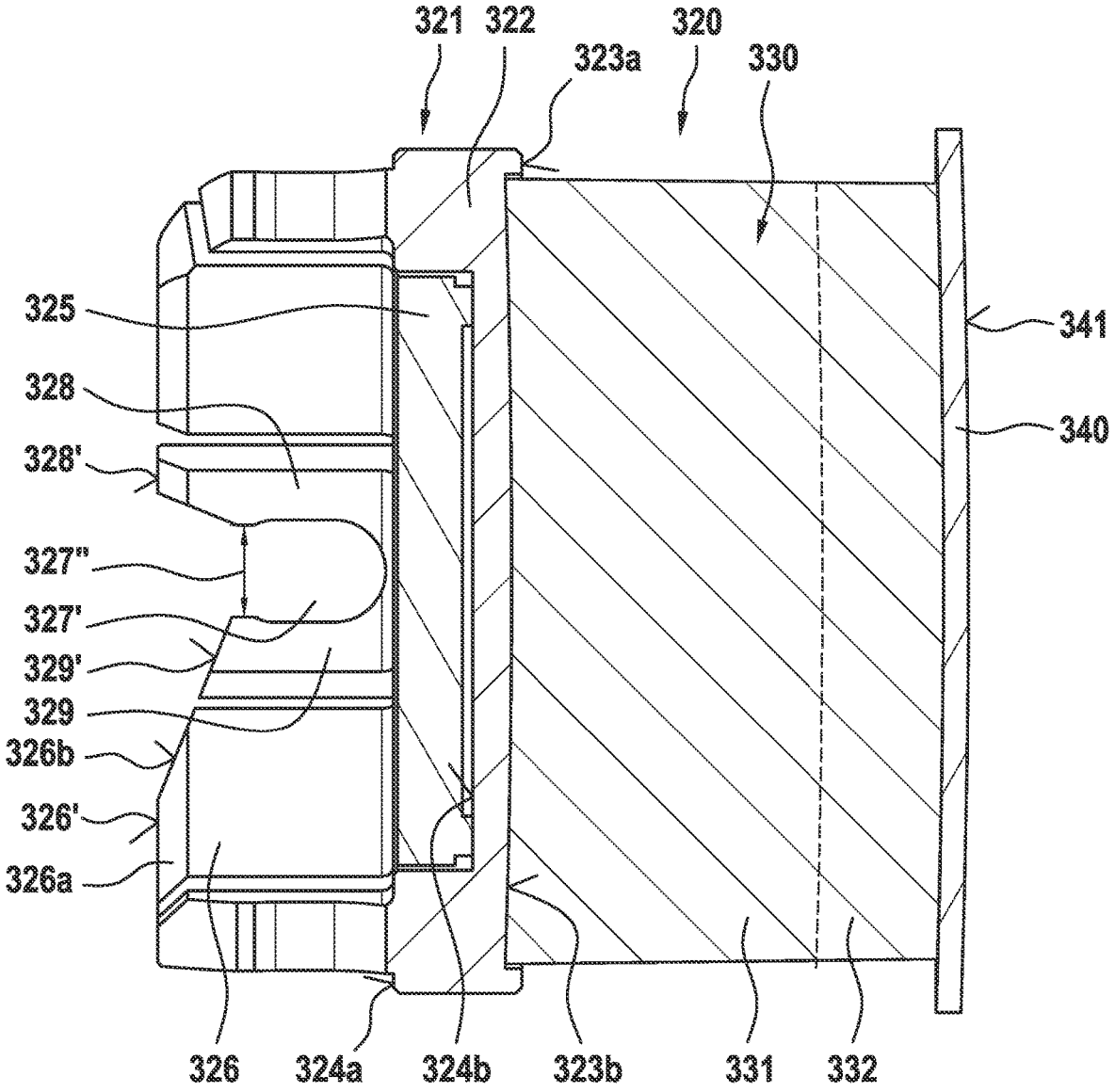
FIG. 8B is a longitudinal section through the processing tool according to FIG. 8A.

In the exemplary embodiment, the tool spindles 30, 30'; 31, 31' are equipped with a processing tool 320 according to FIGS. 8A and 8B.

In the exemplary embodiment, the processing tool 320 is a polishing tool 320 for polishing optical surfaces, in particular the prescription surfaces of lenses for eyeglass lenses.

In the exemplary embodiment, the polishing tool 320 has a circular cylindrical rotational symmetry.

In the illustrated exemplary embodiment, the processing tool 320 has a base body 321 with a base plate 322, an intermediate layer 330 in the form of a foam carrier, and a polishing film or polishing foil 340.

In the exemplary embodiment, the base body 321 is rigid, but at least harder than the intermediate layer 330 and the polishing foil 340, in order to provide the polishing tool 320 with the necessary stability and to allow it to be fixed to the tool spindles 30, 30'; 31, 31'. Suitable materials for the base body 321 are rigid PVC (uPVC) materials.

It is expedient that the base body 321 is formed in one piece, for example injection molded.

The intermediate layer 330 is received in a precisely dimensioned recess 323*b* of the workpiece-side base surface 323*a* of the base plate 322 and is firmly connected to the base plate 322, in the exemplary embodiment glued or adhesively bonded.

In a manner known per se, the recess 323*b* has a defined spherical curvature which produces a corresponding deformation of the intermediate layer 330 and thus a corresponding spherical curvature of the polishing foil 340.

The radius of curvature of the recess 323*b* is between 75 mm and 1,000 mm, typically between 150 mm and 600 mm.

Compared to the prior art, larger radii of curvature of the recess 323*b* have proven to be effective in order to be able to polish larger processing surfaces of the lenses and/or to increase the material removal during polishing.

Of course, both convex and concave curvatures (i.e., positive or negative radii of curvature) of recess 323*b* may be provided to allow optical workpieces 9 with concave or convex optical surfaces, respectively, to be processed.

In the exemplary embodiment, an RFID chip 325 is embedded in a precisely dimensioned recess 324*b* of the spindle-side base surface 324*a* of the base plate 322 and is firmly connected to the spindle-side base surface 324*a*, e.g. cast on or glued or adhesively bonded.

Each RFID chip 325 can be read and/or overwritten in a manner known per se by means of a read-write device.

In the apparatus 1, each RFID chip 325, i.e. each processing tool 320, is assigned its own read-write device (not shown). The corresponding two or four read-write devices are recessed in pairs in the spindle housing 21 in a manner known per se, such that a first pair of read-write devices can be assigned to the processing tools 320 on the upper tool spindles 30, 30' and a second pair of read-write devices can be assigned to the processing tools 320 on the lower tool spindles 31, 31'.

In the exemplary embodiment, the second pair of read-write devices is recessed in the tool spindle side region of the spindle housing 21 such that when the workpiece spindles 20, 20' are in their loading or unloading position, it can interact with the RFID chips 325 of the processing tools 320 on the lower pair of spindles 31, 31'.

Further, in the exemplary embodiment, the first pair of read-write devices is arranged on the opposite side of the spindle housing 21 in an area away from the tool spindles. By pivoting the spindle housing 21 about its B axis by 180° (with a cover of the working chamber 10 open), the first pair of read-write devices can interact with the RFID chips 325 of the processing tools 320 of the lower spindle pair 30, 30'.

On the one hand, the RFID chips 325 and/or the read-write devices associated therewith serve to identify the processing tools 320.

Further, in the exemplary embodiment, the read-write devices overwrite each work cycle of the processing tools 320 on their respective RFID chips 325 so that the number of work cycles, service life, and approaching wear of each processing tool 320 are monitored.

In the exemplary embodiment, an annular receiving region for receiving and centering the tool holder 120 is formed on the spindle-side base surface 324*a* of the base body 321 or base plate 322 in the form of four spring elements 326, preferably spring tongues, and four spring elements 327, preferably spring tongues.

The spring elements 326 are substantially cuboidal in shape. An internal chamfer 326*a* is formed at their free ends 326' and a lateral chamfer 326*b* is formed at one side.

In contrast to the spring elements 326, the spring elements 327 have receiving openings 327', whereby two legs 328, 329 with free ends 328', 329' as well as narrow regions 327" are formed.

The legs 328 have the same height as the spring elements 326 and are also provided with an internal chamfer 328*a*.

The leg 329 has a lower height than the spring tongue or spring element 326 and is formed essentially as a cuboid frustum, wherein all four edges 329" of the cuboid frustum have a different height.

FIG. 8A further shows that the internal chamfer 326*a* of each spring tongue or spring element 326 is arranged adjacent to a leg 329 of the spring tongue or spring element 327.

The connection of the recess 323*b* in the workpiece-side base surface 323*a* of the base plate 322 of the base body 321 to the intermediate layer 330 is designed in such a way that the torque of the tool spindle 30, 30'; 31, 31' can be transmitted from the base body 321 to the intermediate layer 330.

In the illustrated exemplary embodiment, the recess 323*b* and the intermediate layer 330 are adhesively bonded together.

The diameter of the intermediate layer 330 in the exemplary embodiment is between 35 mm and 60 mm.

The intermediate layer 330 is formed in two parts.

A first part 331 is directly (adhesively) bonded to the recess 323*b* of the base plate 322.

A second part 332 is directly (adhesively) bonded to the first part 331.

The polishing foil 340 is directly (adhesively) bonded to the second part 332.

In the exemplary embodiment, both parts are made of a polyurethane foam (PUR foam), wherein the first part 331 preferably consists of a closed-cell PUR foam, while the second part 332 preferably consists of a mixed-cell PUR foam, in order to reduce the influence of the polishing agent on the material properties of the second part 332. Other configurations of the foams and/or other materials for the intermediate layer 330 are of course conceivable.

The first part 331 of the intermediate layer 330 has a higher static modulus of elasticity than the second part 332 of the intermediate layer 330, by a factor of at least 1.2; however, an increase by a factor of 1.5 or 2 is also possible. Accordingly, the first part 331 of the intermediate layer 330 is harder than the second part 332 of the intermediate layer 330.

In the exemplary embodiment, the static modulus of elasticity of the first part 331 is more than 0.4 $N/mm^2$ but less than 2 $N/mm^2$. Good results are achieved with a static modulus of elasticity between 0.75 and 1.75 $N/mm^2$.

In the exemplary embodiment, the static modulus of elasticity of the second part 332 is more than 0.05 $N/mm^2$ but less than 1 $N/mm^2$. Good results are achieved with a static modulus of elasticity between 0.075 and 0.9 $N/mm^2$ as well as between 0.1 and 0.6 $N/mm^2$.

Accordingly, the first part 331 of the intermediate layer 330 has a greater compression hardness than the second part 332 of the intermediate layer 330, by at least a factor of 2; however, an increase by a factor of 3 or 4 is also possible.

In the exemplary embodiment, the compression hardness of the first part 331 is between 0.05 $N/mm^2$, and 0.3 $N/mm^2$. Good results are achieved with a compression hardness between 0.12 and 0.2 $N/mm^2$, in particular 0.15 $N/mm^2$.

In the exemplary embodiment, the compression hardness of the second part 332 is between 0.01 $N/mm^2$ and 0.1 $N/mm^2$. Good results are achieved with a compression hardness between 0.02 and 0.08 $N/mm^2$, in particular with compression hardnesses of 0.031 and 0.047 $N/mm^2$.

The first, harder part 331 of the intermediate layer 330 is formed significantly thicker than the second, softer part 332 of the intermediate layer 330 to enable precise polishing and to reduce the center offset of the processing tool 320 during the polishing process.

The first part 331 is at least a factor of 1, but at most a factor of 3 thicker than the second part 332 of the intermediate layer 330. Good results are achieved with a thickness of the first part 331 between 10 and 14 mm and a thickness of the second part 332 between 6 and 9 mm.

The total thickness of the intermediate layer 330 should not exceed 22 mm.

The polishing foil 340 is made of a polyurethane material and has a larger diameter than the intermediate layer 330, so that it protrudes over the edges of the intermediate layer 330.

In the exemplary embodiment, the polishing foil 340 further has a thickness of 0.08 to 2 mm, wherein good results are achieved with a thickness of 1.2 mm.

The radius of curvature of the polishing foil 340 or its polishing surface 341 is typically larger than the radius of curvature of the recess 323*b*, typically by at least 100 mm. This depends, in a manner known per se, on the thickness of the intermediate layer 330 as well as the material properties of intermediate layer 330 and polishing foil 340.

Compared to the prior art, larger radii of curvature of the recess 323*b* and/or polishing surface 341 have proven useful in order to be able to polish larger processing areas of the lenses and/or increase the amount of material removed during polishing.

Figure 9:
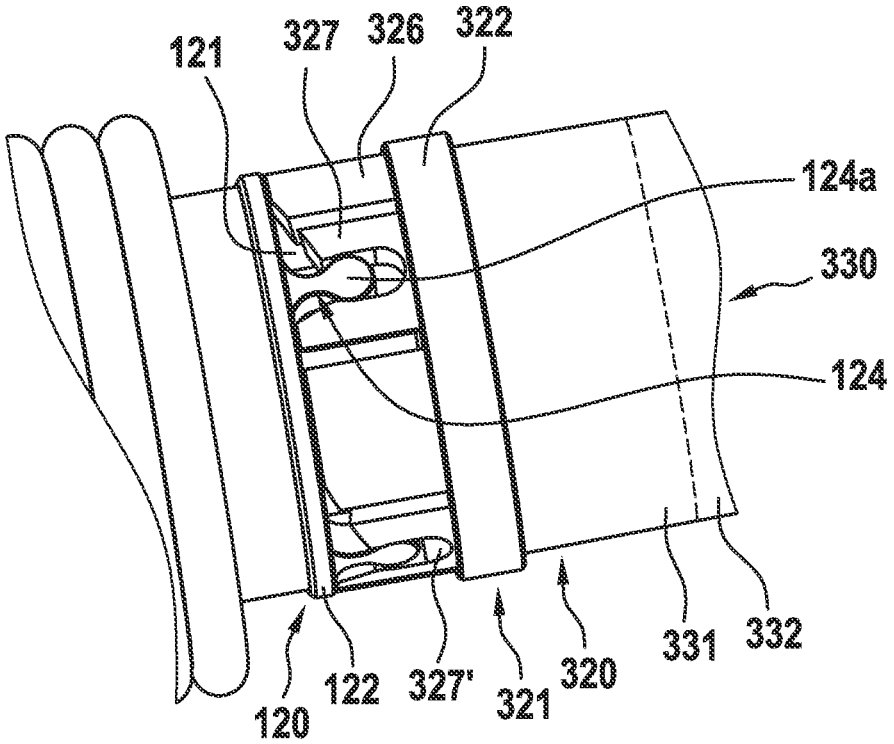
FIG. 9 is an enlarged view of the processing tool connected to the tool holder according to FIG. 8A.

The connection of the processing tool 320 to the tool holder 120 is shown enlarged in FIG. 9.

A torque can be transmitted from the tool spindle 30, 30'; 31, 31' to the processing tool 320 via the tool holder 120 and/or the spindle disk 133.

The connection of the processing tool 320 to the tool holder 120 is reversible, so that the change of the processing tool 320 in the event of wear or damage can be carried out manually in a simple manner.

As can be seen from FIG. 9, the spring elements 326, 327 of the receiving region of the base body 321 are pushed onto the annular holder head 121 of the tool holder 120 in such a way that the free ends 326' of the spring elements 326 and the free ends 328', 329' of the legs 328, 329 abut on the collar 122 of the tool holder 120.

In this case, the legs 328, 329 of each spring tongue or spring element 327 each enclose a retaining lug or retaining element 124 of the tool holder 120. The narrow regions 327" formed by the receiving openings 327' lie in this case behind the retaining lug head or retaining element head 124*a*, in such a way that the base body 321 is held in a clamping manner.

Furthermore, it can be seen that the retaining lug heads or retaining element heads 124*a* do not completely fill the receiving openings 327'. This has the advantage that greater variations in the manufacturing tolerances are acceptable when manufacturing the base body 321, for example by means of injection molding, so that the base body 321 of the processing tool 320 can be regarded as a mass-produced article that can be manufactured inexpensively.

The tool holder 120 is characterized in particular in that a processing tool 320 is rigidly held, i.e. any moving and/or elastic parts between the tool holder 120 and the processing tool 320, such as in particular a ball head, rubber-elastic parts or flexure bearings, are dispensed with. In other words, the necessary deflection of the processing tool 320 during the processing operation, in particular the polishing process, takes place exclusively by means of the two-part elastic intermediate layer 330. Thus, the processing tool 320 can be controlled and/or guided much more precisely during the processing operation than is known in the prior art.

The tool holder 120 is further characterized in that it is firmly mounted on the spindle head of the polishing spindle and only the processing tool 320 itself is manually exchanged in the event of wear or damage.

The preferred design of the spring elements 326, 327 has the effect that an operator can fit or plug the base body 321 of the processing tool 320 onto a tool holder 120 without requiring a free field of view for this purpose.

For this purpose, the basic body 321 is pushed onto the annular holder head 121 until resistance is felt (because, for example, the free ends of the spring elements 326, 327 rest or abut on the retaining elements 124). Then the base body 321 is rotated clockwise on the holder head 121 until resistance is again felt. In this position, the retaining elements 124 rest against the chamfered free ends 328' of the longer legs 328 so that clockwise movement is blocked. Now the operator knows that the retaining elements 124 are positioned opposite the receiving openings 327' corresponding thereto. The base body 321 is now in the correct position on the annular holder head 121 and can now be pushed on, as shown in FIG. 9.

As a result, a structurally simple, stable and joint-free and/or rigid connection of the processing tool 320 via the tool holder 120 to the spindle head 310 of each tool spindle 30, 30'; 31, 31' is obtained. Furthermore, the processing tool 320 can be mounted or plugged on the tool holder 120 in a simple manner as described and can be removed or pulled off again when changing tools.

The apparatus 1 of the shown embodiment operates preferably as follows. Individual method steps may be implemented differently or in different order or omitted completely, for example steps regarding transfer of workpieces, in particular if the individual devices/stations in the apparatus have a different arrangement than shown.

As a starting point, it is assumed that a first pair of optical workpieces 9, preferably optical lenses for eyeglass lenses, is cleaned in the cleaning station 70 and a second pair of optical workpieces 9 is processed, in the exemplary embodiment polished, in the working chamber 10.

At the same time, the empty conveying containers 4' for accommodating or receiving these two pairs of workpieces 9 are moved forward on the conveyor device 4 in a synchronized manner past the working chamber 10 in the direction of the cleaning station 70. Behind them follow conveying containers 4' containing optical workpieces 9 to be processed.

The handling device 100 is positioned at the level of the cleaning station 70, since the processing operation in the working chamber 10, in this exemplary embodiment the polishing operation, takes considerably more time than the cleaning operation in the cleaning station 70.

As soon as the cleaning operation is finished, the cleaning station 70 is opened. The workpiece spindles 80, 80' with the cleaned and blocked optical workpieces 9 are moved upwards in the direction of the X axis of the apparatus 1 until the optical workpieces 9 protrude from the cleaning station 70.

The handling device 100 grips the cleaned optical workpieces 9 at their edges by means of the second pick-up devices 108 (here: 4-finger grippers) of its holding devices 103, 103' and removes the optical workpieces 9 from the workpiece spindles 80, 80'. The swivel arm 101 of the handling device 100 swivels about its swivel axis 101' in the direction of the conveyor device 4. The cleaned optical workpieces 9 are deposited in the conveying container 4' assigned to them, which in the meantime has been further advanced on the conveyor device 4 along the apparatus 1.

The conveying container 4' with the finished optical workpieces 9 deposited therein is transported out of the apparatus 1 on the conveyor device 4.

The handling device 100 now moves on the guide rails 112 along the Y-axis of the apparatus 1 in the direction of the working chamber 10.

Now the cross strut 102 of the swivel arm 101 swivels about its swivel axis 102' in such a way that now the first pick-up devices 107 (here: suction cups) are oriented towards the conveying containers 4'. A third pair of unprocessed optical workpieces 9 is gripped centrally by the first pick-up devices 107 (here: suction cups).

Subsequently, the swivel arm 101 of the handling device 100 swivels about its swivel axis 101' in the direction of the working chamber 10, and the cross strut 102 of the swivel arm 101 swivels about its swivel axis 102' in such a way that now the second pick-up devices 108 (here: 4-finger grippers) are oriented towards the working chamber 10.

In the meantime, the polishing process with respect to the second pair of optical workpieces 9 is completed, and the working chamber 10 is opened. The B-axis housing 22 with the gear motor 26 located therein and the B-axis disk or B-axis flange 23 is lifted along the X-axis of the apparatus 1 together with the spindle housing 21 and the workpiece spindles 20, 20' accommodated therein. This brings the finished polished optical workpieces 9 held on the workpiece spindles 20, 20' within reach of the second pick-up devices 108 (here: 4-finger grippers) of the holding devices 103, 103'. These now grip the second pair of finished polished optical workpieces 9 at the edge and remove the optical workpieces 9 from the workpiece spindles 20, 20'.

The cross strut 102 of the swivel arm 101 then swivels about its swivel axis 102' in such a way that the first pick-up devices 107 (here: suction cups) loaded with the third pair of optical workpieces 9 to be processed are now oriented toward the working chamber 10.

The workpiece spindles 20, 20' are loaded with the third pair of optical workpieces 9. The workpiece spindles 20, 20' are lowered into the working chamber 10 along the X-axis of the apparatus 1 in the reversal of the operation described above. The working chamber 10 is closed and the processing operation, in this case the polishing process, begins.

The time interval between removing the finished polished optical workpieces 9 from the workpiece spindles 20, 20' and reloading them with optical workpieces 9 to be polished is approximately 10 seconds. This time interval is used to perform an inspection of the processing tools 320.

For this purpose, the perpendicular or vertical laser beam 51 described further above is directed at the processing tool 320 of the upper tool spindle 30' closest to the device 50, and the oblique laser beam 52 described further above is directed at the processing tool 320 of the corresponding lower tool spindle 31', while the processing tools 320 are slowly rotated. The laser beams 51, 52 thereby detect the circumferential surfaces of the base body 321 and intermediate layer 330 of each processing tool 320 as well as the circumferential edge of the projecting rear surface of the polishing foil 340 facing the intermediate layer 330.

Subsequently, the device 50 for tool inspection moves along the Y-axis of the apparatus 1 on the profile or guide rails 57 to the tool spindles 30, 31. Now, the processing tools 320 received on these tool spindles 30, 31 are inspected as described.

This inspection of the processing tools 320 takes significantly less than 10 seconds, so it is completed before the handling device 100 is ready to reload the workpiece spindles 20, 20' with optical workpieces 9 to be polished.

As a result, a 360° coverage of the entire circumferential surfaces of all tools 320 is obtained.

Three types of defects can be identified:

1. cracks in the peripheral edge of the polishing foil 340;
2. cracks in the intermediate layer 330; and
3. total loss of a processing tool 320.

The risk for total loss is minimized by detecting cracks in the intermediate layer 330 so that the affected processing tool 320 can be exchanged before total loss.

After performing the tool inspection and reloading the workpiece spindles 20, 20', the handling device 100 moves on the guide rails 112 along the Y-axis of the apparatus 1 in the direction of the cleaning station 70.

Now the cross strut 102 of the swivel arm 101 swivels about its swivel axis 102' in such a way that now the second pick-up devices 108 (here: 4-finger grippers) loaded with the finished polished second pair of optical workpieces 9 are oriented towards the cleaning station 70. The second pair of workpieces 9 to be cleaned is placed on the workpiece spindles 80, 80' of the cleaning station 70. The workpiece spindles 80, 80' are moved downward in the direction of the X-axis of the apparatus 1 in reversal of the operation described above until the optical workpieces 9 are completely received in the cleaning station 70. The cleaning station 70 is closed and the cleaning process begins.

Now the cycle just described starts again from the beginning.

Figure 10A:
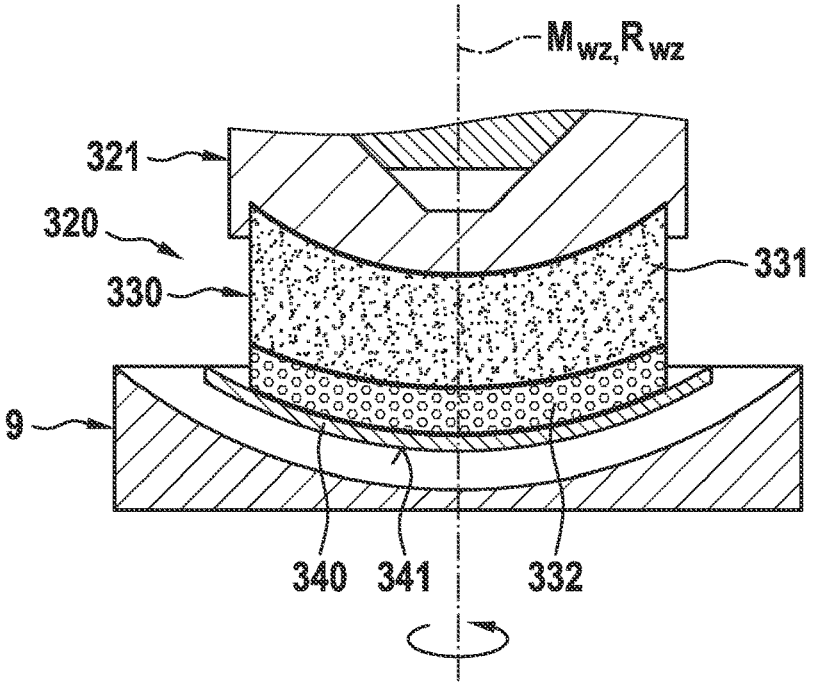
FIG. 10A is a section through a processing tool and an assigned workpiece, wherein the processing tool is spaced from the workpiece.
Figure 10B:
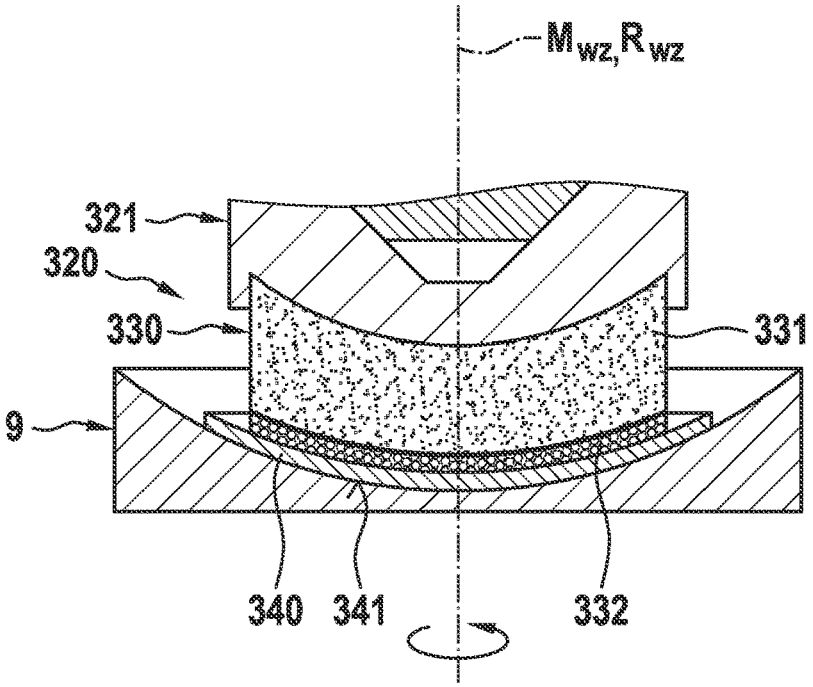
FIG. 10B is a view according to FIG. 10A, wherein the processing tool is in a central processing position.
Figure 10C:
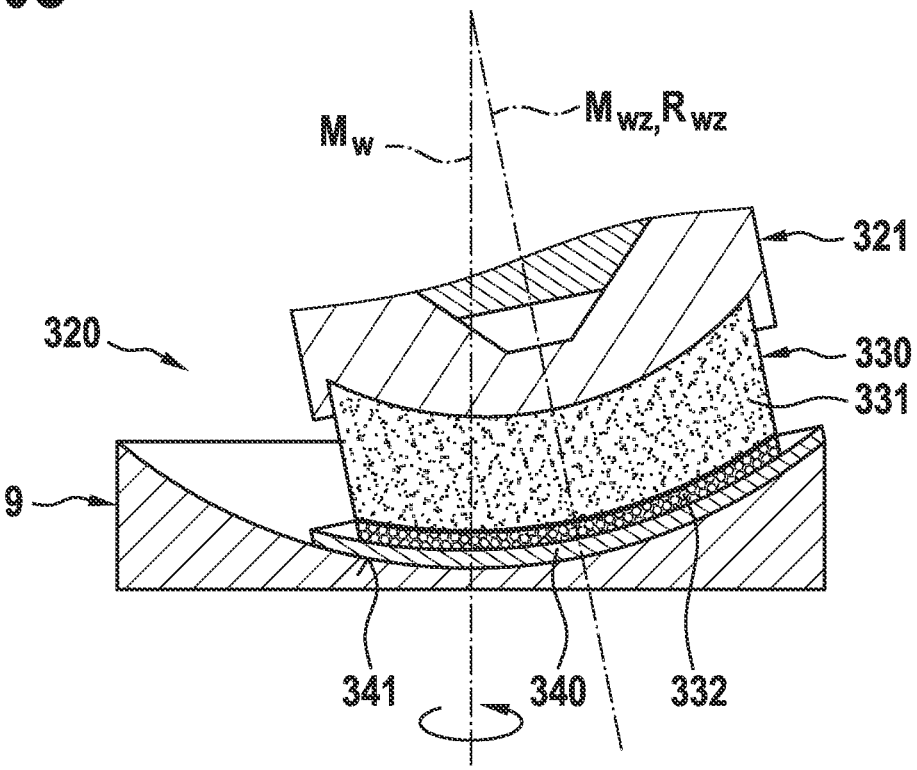
FIG. 10C is a view according to FIG. 10B, wherein the processing tool is in an off-center processing position.

According to a particularly preferred aspect of the present invention, the following polishing process or polishing method can be carried out with the apparatus 1 in combination with the tool holder 120 and the processing tool 320 (cf. FIGS. 10A to 11):

As soon as the workpiece spindles 20, 20' are loaded and the working chamber 10 is closed, the spindle plate or spindle housing 21 swivels by 90° about its B axis so that the processing tools 320 and the workpieces 9 to be polished are arranged opposite each other.

Now, first the upper tool spindle pair 30, 30' is fed or advanced or moved along the Z axis of the apparatus 1 in a manner known per se. The path length of the infeed stroke or infeed lift depends on the geometry of the surface to be processed of the respective optical workpieces 9.

During the polishing process, only the oscillation stroke or oscillation lift of the tool spindles 30, 30' (lifting rods 314, see FIG. 7D) operates.

After completion of the polishing process, the finished polished optical workpieces 9 are either removed from the working chamber 10 (single-stage polishing) or they are moved down along the X-axis of the apparatus 1 and arranged opposite the second pair of tool spindles 31, 31', after which the polishing process starts again (two-stage polishing, pre-polishing and post-polishing).

The processing tool 320 and/or the polishing foil 340 has a tool axis which forms a center axis $M_{WZ}$ and/or rotation axis $R_{WZ}$. Typically, the tool axis corresponds to the center axis $M_{WS}$ of the workpiece spindles 20, 20'.

In an exemplary embodiment of a polishing method, the radius of curvature of the polishing surface 341 of the polishing foil 340 is larger than the largest radius of curvature of the optical workpiece 9 to cause an annular contact surface when the processing tool 320 is pressed against the optical workpiece 9. In this way, the removal rate can be increased compared to point contact surfaces and/or when the radius of curvature of the polishing surface 341 is smaller.

During the polishing process, the polishing surface 341 of the polishing foil 340 and the optical surface of the optical workpiece 9 to be polished are in direct contact with each other. Here, the polishing surface 341 lies with its entire surface on the optical surface.

The polishing pressure is kept constant during the polishing process within a tolerance range and is between 0.01 and 0.1 $N/mm^2$.

The diameter of the optical workpieces 9 to be polished is typically larger than the diameter of the polishing foil 340.

During the polishing process, the rotational speed of the tool spindles 30, 30'; 31, 31' is typically greater than the rotational speed of the workpiece spindles 20, 20' by a factor of 1, 5 or 2, wherein the rotational speed of the tool spindles 30, 30'; 31, 31' is 1,500 rpm or 2,000 rpm.

Figure 11:
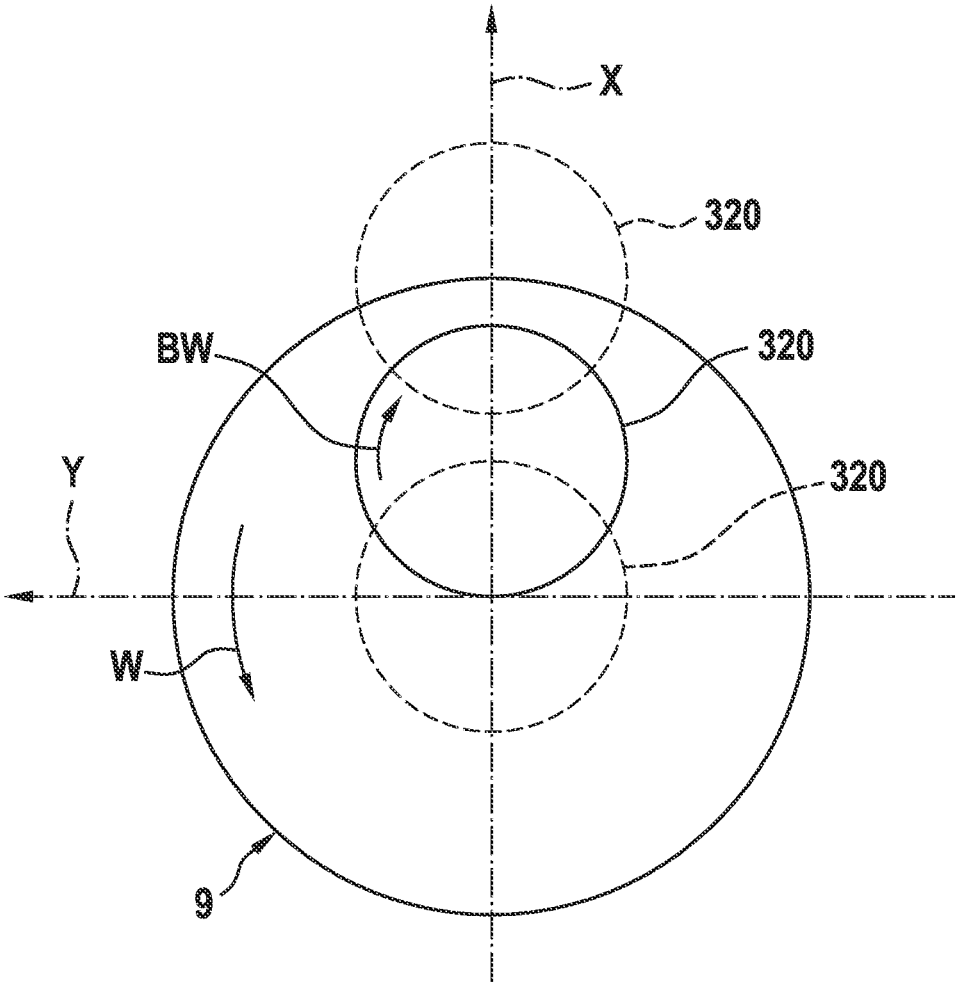
FIG. 11 is the processing positions of the processing tool relative to the workpiece in a plan view.

In this process, the optical workpiece 9 typically rotates in the direction of the arrow W in the opposite direction to the processing tool 320, which rotates in the direction of the arrow BW (cf. FIG. 11).

The duration of the polishing process is typically between 30 and 120 seconds.

During the polishing process, the two-part intermediate layer 330 of the processing tool 320 is compressed, wherein the second, softer part 332 is more compressed than the first, harder part 331. Typically, the intermediate layer 330 is compressed by 5 to 80%, wherein good results are achieved with a compression of between 10 and 25%. The above values refer to the original thickness of the intermediate layer 330.

Furthermore, the polishing foil 340 can yield or give way in radial direction, i.e. transversely to the center axis $M_{WZ}$ of the tool spindles 30, 30'; 31, 31', in order to enable adaptation to radii of curvature of the surface to be polished of the optical workpiece 9 changing in circumferential direction. This is the case, for example, with toric surfaces.

For example, the intermediate layer 330 may be more compressed in a deflected or off-center processing position at the edge of the optical workpiece 9 than in the center of the optical workpiece 9. This creates a center offset.

Due to the joint-free and/or rigid structure of the tool holder 120, the deflection and/or center offset of the processing tool 320 occurs solely by means of the two-part intermediate layer 330.

This, in combination with the structure of the intermediate layer 330 with a harder first part 331 and a softer second part 332, has the effect that the processing tool 320 and/or the center axis $M_{BW}$ of the processing tool 320 can be moved up to or over the edge of the optical workpiece 9 without the polishing foil 340 lifting off from the optical surface of the optical workpiece 9 to be polished.

Known apparatuses with an articulated or joint connection of the processing tool to the tool spindle (for example, with a ball-and-socket joint or a flexure bearing), in contrast, would tilt in a processing position in which the center axis of the processing tool is moved over the edge of the optical workpiece 9 in such a way that the polishing foil of the processing tool loses contact with the optical surface of the optical workpiece to be polished.

With the processing tool 320, it is thus possible to perform a surface polishing and/or a polishing with a high removal rate even in the edge area of the optical workpiece 9 continuously and with the required accuracy.

The proposed polishing process or polishing method results in a longer service life of the processing tools 320.

Optimally, the processing tool 320 is changed approximately every 4 hours or approximately every 15,000 seconds.

Individual aspects, features and method steps of the present invention can be implemented independently from each other, but also in any combination or order.

The present invention relates in particular to any one of the following aspects which can be realized independently or in any combination, also in any combination with any aspects above:

1. Apparatus (1) for processing optical workpieces (9), with a working space (12),
   wherein a pair of workpiece spindles (20, 20') for receiving and holding the optical workpieces (9) and a pair of tool spindles (30, 30') with processing tools (320) receivable thereon for processing the optical workpieces (9) are arranged in the working space (12),
   wherein the tool spindles (30, 30') are arranged rotatably about their respective center axis $M_{WZ}$, at least one device for rotational drive for the pair of tool spindles (30, 30') being provided outside the working space (12),
   wherein a device for linear drive for the pair of tool spindles (30, 30') along their center axes $M_{WZ}$ is provided outside the working space (12),
   characterized
   in that the device for linear drive has a slide (35) on which the pair of tool spindles (30, 30') is mounted, and in that the slide (35) is arranged linearly movably on a linear guide (33, 33'; 37, 37') along the center axes $M_{WZ}$ of the pair of tool spindles (30, 30').
2. Apparatus (1) for processing optical workpieces (9), with a working space (12),
   wherein workpiece spindles (20, 20') for receiving and holding the optical workpieces (9) and tool spindles with processing tools (320) receivable thereon for processing the optical workpieces (9) are arranged in the working space (12),
   wherein the tool spindles are arranged rotatably about their center axis $M_{WZ}$
   wherein the tool spindles are arranged to be linearly movable along their center axes $M_{WZ}$;
   characterized
   in that at least two pairs of tool spindles (30, 30'; 31, 31') are provided,
   in that at least one device for rotational drive is provided for the at least two pairs of tool spindles (30, 30'; 31, 31'),
   in that at least one device for linear drive is provided for the at least two pairs of tool spindles (30, 30'; 31, 31') along their center axes $M_{WZ}$.
3. Apparatus according to aspect 2, characterized in that each device for linear drive has at least two slides (35, 36), on each of which a pair of tool spindles (30, 30'; 31, 31') is mounted, and in that each slide (35, 36) is arranged linearly movably on a linear guide (33, 33'; 37, 37'; 34, 34'; 38, 38') along the center axes $M_{WZ}$ of the respective pair of tool spindles (30, 30'; 31, 31').
4. Apparatus according to one of the preceding aspects, characterized in that a handling device (100) for handling the optical workpieces (9) is provided outside the working space (12) on a first side of the working space (12), and in that the at least one device for linear drive is arranged on a second side of the working space (12) facing away from the first side of the working space (12).
5. Apparatus according to one of the preceding aspects, characterized in that each device for rotational drive synchronously rotationally drives a pair of tool spindles (30, 30'; 31, 31'), respectively.
6. Apparatus according to one of the preceding aspects, characterized in that each device for linear drive of the respective pair of tool spindles (30, 30'; 31, 31') further comprises a toothed rack (41, 41') fixed to the respective slide (35, 36) and meshing with a rotationally drivable toothed wheel (42, 42').
7. Apparatus according to one of the preceding aspects, characterized in that each device for linear drive is arranged on at least one base plate (32).
8. Apparatus according to aspect 7, characterized in that a base plate (32) is provided, that a first device for linear drive is arranged on an upper side (32*a*) and a second device for linear drive is arranged on a lower side (32*b*) of the base plate (32).

9. Apparatus according to aspect 8, characterized in that the second device for linear drive is arranged substantially mirrored to the first device for linear drive, the base plate (32) forming the mirror plane.

10. Apparatus according to one of the preceding aspects, characterized in that each tool spindle (30, 30'; 31, 31') is connected to a tool holder (120) on which a processing tool (320) is rigidly received or held.

11. Method for processing optical workpieces (9), characterized in that a pre-processing step is performed with a first pair of tool spindles (30, 30') having first processing tools (320) received thereon, and in that immediately thereafter a post-processing step is performed with a second pair of tool spindles (31, 31') with second processing tools (320) received thereon.

List of reference signs:

| | | | |
|---|---|---|---|
| 1 | Apparatus | 32b | Lower side of the base plate |
| 2 | Casing | 33, 33' | Upper pair of guide rails |
| 3 | Part from 2 | 34, 34' | Lower pair of guide rails |
| 4 | Conveyor device | 35 | Upper slide |
| 4' | Conveying container | 36 | Lower slide |
| 5 | Control panel | 37, 37' | Upper guide carriages |
| 6 | Component of machine frame | 38, 38' | Lower guide carriages |
| | | 39, 39' | Holder |
| 8 | Block piece | 41, 41' | Toothed rack |
| 9 | Optical workpiece | 42, 42' | Toothed wheel |
| 10 | Working chamber | 43, 43' | Motor |
| 11 | Chamber housing | 44, 44' | (V-ribbed) belt |
| 12 | Working space | 45, 45' | Pulleys |
| 20, 20' | Workpiece spindles | 46, 46' | Motor |
| 21 | Spindle housing | 47, 47' | Device for rotational drive |
| 22 | B-axis housing | 48, 48' | Device for linear drive |
| 23 | B-axis flange | 50 | Device for tool inspection |
| 24 | X-axis motor | 51 | Perpendicular laser beam |
| 25 | Swivel drive | 52 | Oblique laser beam |
| 26 | Gear motor | 53 | Cabling |
| 30, 30' | Tool spindle pair (e.g. for pre-polishing) | 54 | Retaining element |
| | | 55 | Retaining plate |
| 31, 31' | Tool spindle pair (e.g. for post-polishing) | 56 | Carrier element |
| | | 57 | Guide rail/Profile rail |
| 32 | Base plate | 58 | Guide carriage |
| 32a | Upper side of the base plate | 59 | Pneumatic or hydraulic cylinder |
| 59' | Connecting element | | |
| 61 | Guide rail/Profile rail | 91a | Upper side of the retaining ring |
| 62 | Pneumatic or hydraulic cylinder | 92 | Gripping element |
| | | 93 | Inner plate |
| 62' | Connecting element | 94 | Central opening |
| 70 | Cleaning station | 95 | Lifting rod |
| 71 | Housing | 96 | Lifting piston |
| 72 | Partitioning wall | 97 | Piston plate |
| 73 | Cover plate | 98 | Compression spring |
| 74 | Recess | 98a | First receptacle |
| 75 | Lid | 98b | Second receptacle |
| 76 | Hydraulic or pneumatic cylinder | 100 | Handling device |
| 77 | Motor | 101 | U shaped swivel arm |
| 78a, 78b | Pulleys | 101' | Swivel axis of 101 |
| 78' | Recess of 78a, b | 102 | Cross strut |
| 79 | V-ribbed belt | 102' | Swivel axis of 102 |
| 80, 80' | Workpiece spindles | 103, 103' | Holding devices |
| 81 | Base plate | 104 | Holding arm |
| 82 | Lifting cylinder | 105 | Swivel drive |
| 83, 83' | Sensors | 106 | Belt drive |
| 84a, 84b | Cleaning fluid nozzles | 107 | First pick-up device |
| 85a, 85b | Cleaning fluid jets | 108 | Second pick-up device |
| 86a, 86b | Compressed air nozzles | 110 | Slide |
| 87a, 87b | Compressed air pulse | 111 | Guide carriage |
| 90 | Collet | 112 | Guide rails |
| 91 | Retaining ring | 113 | Motor |
| 121' | Outer wall of 121 | 120 | Tool holder |
| 122 | Collar | 121 | Annular holder head |
| 123 | Annular rim | 313 | Spindle shaft |
| 124 | Retaining element/Retaining lug | 314 | Lifting rod |
| | | 315 | Cap |
| 124a | Head of 124 | 315a | Free surface of 315 |
| 125 | Cylindrical extension | 316 | Lifting cylinder |
| 126 | Annular holder body | 320 | Processing tool |
| 127 | Bellows | 321 | Base body |
| 127' | First free end of the bellows | 322 | Base plate |
| 127" | Second free end of the bellows | 323a | Workpiece-side base surface |
| 127a | Inner circumferential bead | | |
| 128 | Clamp | 323b | Recess |
| 129 | Disk | 324a | Spindle side base surface |

-continued

| List of reference signs: | | | |
|---|---|---|---|
| 129a | Annular spring | 324b | Recess |
| 130 | Spindle flange | 325 | RFID chip |
| 131 | Collar | 326 | Spring element (cuboid-shaped) |
| 132 | Annular circumferential indentation | 326' | Free end of 326 |
| 133 | Spindle disk | 326a | Internal chamfer of 326 |
| 134 | Recesses | 326b | Lateral chamfer of 326 |
| 135 | Spring element | 327 | Spring element |
| 135' | Free end of the spring element | 327' | Receiving opening |
| 310 | Spindle head | 327" | Narrow region |
| 311 | Bellows | 328 | Longer leg |
| 312 | Bolt | 328' | Free end of 328 |
| 312a | Bolt head | 328a | Internal chamfer of 328 |
| 312b | Annular recess | 329 | Shorter leg |
| 332 | Second part of 330 | 329' | Free end of 329 |
| 340 | Polishing foil | 329" | Edges from 329 |
| 341 | Polishing surface | 330 | Intermediate layer |
| B | Axis | 331 | First part of 330 |
| BB | Direction | $M_{WS}$ | Center axis of workpiece spindle (X direction) |
| BW | Direction of rotation (tool) | | |
| C | Direction | $M_{WZ}$ | Center axis of tool spindle |
| F1 | Direction of force | $R_{BW}$ | Rotation axis of processing tool |
| F2 | Direction of force | | |
| D | Compressed air | $R_{RWS}$ | Rotation axis of workpiece spindle for cleaning |
| H | Oscillation stroke | | |
| $M_{BW}$ | Center axis of processing tool | $R_W$ | Rotation axis of workpiece |
| $M_W$ | Center axis of workpiece | $R_{WS}$ | Rotation axis of workpiece spindle |
| | | $R_{WZ}$ | Rotation axis of tool spindle |
| | | W | Direction of rotation (workpiece) |
| | | X | Axis/direction |
| | | Y | Axis/direction |
| | | Z | Axis/direction |

What is claimed is:

1. An apparatus configured to process optical workpieces, comprising:

a working space, a pair of workpiece spindles configured to receive and hold the optical workpieces, respectively the pair of workpiece spindles being arranged in the working space, a pair of tool spindles, each configured to receive a processing tool to process the optical workpieces thereon, the pair of tool spindles arranged in the working space and rotatable about their respective center axes, the center axis of each tool spindle extending in a longitudinal direction of the tool spindle along an axis of rotation of the tool spindle, the center axes also being in a horizontal direction, a device, common to both tool spindles, configured to synchronously and rotationally drive the pair of tool spindles about their respective center axes, the device located outside the working space, and a device configured for horizontal linear drive for the pair of tool spindles along their respective center axes, the device for horizontal linear drive being provided outside the working space, wherein the device for horizontal linear drive has a slide on which the pair of tool spindles is mounted, and wherein the slide is arranged linearly movably on a linear guide in the horizontal direction along the center axes of the pair of tool spindles.

2. The apparatus according to claim 1, wherein the device for horizontal linear drive further comprises a toothed rack fixed to the slide and meshing with a rotationally drivable toothed wheel.

3. The apparatus according to claim 1, wherein a handling device for handling the optical workpieces is provided outside the working space on a first side of the working space, and wherein the device for horizontal linear drive is arranged on a second side of the working space facing away from the first side of the working space.

4. The apparatus according to claim 3, wherein the handling device is designed to be linearly movable along an axis of the apparatus, so that the handling device can approach both a working chamber forming the working space and a cleaning station.

5. The apparatus according to claim 1, wherein the device for horizontal linear drive is for synchronously linearly driving the pair of tool spindles.

6. The apparatus according to claim 1, wherein each tool spindle of the pair of tool spindles is connected to a tool holder on which a processing tool of the processing tools is rigidly received or held.

7. The apparatus according to claim 1, wherein the apparatus comprises a cleaning station, wherein two cleaning fluid nozzles and two compressed air nozzles are provided per workpiece spindle of the cleaning station.

8. The apparatus according to claim 7, wherein the cleaning station or a workpiece spindle thereof comprises a collet for receiving an optical workpiece, the collet having a retaining ring which is received and fixed in a suitable recess at a free end of the workpiece spindle of the cleaning station and three gripping elements integrally connected to an upper side of the retaining ring forming a flexure bearing or flexure hinge.

9. An apparatus configured to process optical workpieces, comprising:

a working chamber having a chamber housing which encloses a working space, workpiece spindles configured to receive and hold the optical workpieces, respectively at least two pairs of tool spindles each configured to receive a processing tool to process the optical workpieces thereon, the at least two pairs of tool spindles being arranged to be rotatable about their respective center axes and to be linearly movable along their respective center axes, the center axis of each tool spindle extending in a longitudinal direction of the tool spindle along an axis of rotation of the tool spindle, at least one device for rotational drive for the at least two pairs of tool spindles, the at least one device for rotational drive being provided outside the working space, and at least one device for linear drive for the at least two pairs of tool spindles along their respective center axes, the at least one device for linear drive being provided outside the working space, wherein each or the at least one device for linear drive is arranged on at least one base plate, wherein a first device of the at least one device for linear drive is arranged on an upper side of a first base plate of the at least one base plate and a second device of the at least one device for linear drive is arranged on a lower side of the first base plate of the at least one base plate, wherein one pair of tool spindles of the at least two pairs of tool spindles has one common linear device of the at least one device for linear drive, and wherein the at least two pairs of tool spindles are arranged within the same working space.

10. The apparatus according to claim 9, wherein one pair of tool spindles of the at least two pairs of tool spindles has one common rotational device of the at least one device for rotational drive.

11. The apparatus according to claim 9, wherein the first and second devices for linear drive of the at least one device for linear drive are provided having one slide each, wherein on each slide a pair of tool spindles of the at least two pairs of tool spindles is mounted, and wherein each slide is arranged linearly movably on a linear guide along the center axes of the respective pair of tool spindles.

12. The apparatus according to claim 9, with at least one of: each or the at least one device for rotational drive, respectively, synchronously rotationally driving one pair of the at least two pairs of tool spindles; or each device for linear drive, respectively, synchronously linearly drives one pair of the at least two pairs of tool spindles.

13. The apparatus according to claim 9, wherein each device for linear drive of the respective pair of tool spindles further comprises a toothed rack fixed to a respective slide and meshing with a rotationally drivable toothed wheel.

14. The apparatus according to claim 9, wherein the second device of the at least one device for linear drive is arranged substantially mirrored to the first device of the at least one device for linear drive, the at least one base plate forming the mirror plane.

15. The apparatus according to claim 9, wherein the apparatus comprises a device for tool inspection in order to be able to detect damage or even total loss of a processing tool of the processing tools, wherein a first laser beam of the device for tool inspection is configured to inspect the processing tools received on a first pair of tool spindles of the at least two pairs of tool spindles and a second laser beam of the device for tool inspection is configured to inspect the processing tools received on a second pair of tool spindles of the at least two pairs of tool spindles.

16. The apparatus according to claim 9, wherein the apparatus comprises an outer casing enclosing a plurality of work stations, including the working chamber with the chamber housing.

17. A method for processing optical workpieces comprising:

performing a pre-processing step with a first pair of tool spindles having first processing tools received thereon, respectively, and performing immediately thereafter a post-processing step with a second pair of tool spindles with second processing tools received thereon, respectively, the tool spindles of the first and second pair of tool spindles having respective center axes, the center axis of each tool spindle extending in a longitudinal direction of the respective tool spindle along an axis of rotation of the respective tool spindle, and linearly moving the first and/or the second pair of tool spindles simultaneously by a common linear drive device along their respective center axes.

18. The method according to claim 17, wherein at least one of the first and second processing tools are pneumatically biased against the respective workpieces during processing.

19. The method according to claim 17, wherein the method further comprises rotationally moving the first and/or the second pair of tool spindles simultaneously by a common rotational drive device about their respective center axes.

* * * * *